US008509464B1

(12) United States Patent
Kato et al.

(10) Patent No.: US 8,509,464 B1
(45) Date of Patent: Aug. 13, 2013

(54) MULTI-CHANNEL AUDIO ENHANCEMENT SYSTEM

(75) Inventors: Hideaki Kato, Yokohama (JP); Alan Kraemer, Irvine, CA (US); Sarah Yang, Irvine, CA (US)

(73) Assignee: DTS LLC, Calabasas, CA (US)

( * ) Notice: Subject to any disclaimer, the term of this patent is extended or adjusted under 35 U.S.C. 154(b) by 50 days.

(21) Appl. No.: 13/286,082

(22) Filed: Oct. 31, 2011

Related U.S. Application Data

(63) Continuation of application No. 11/963,679, filed on Dec. 21, 2007, now Pat. No. 8,050,434.

(60) Provisional application No. 60/876,248, filed on Dec. 21, 2006.

(51) Int. Cl.
*H04R 5/02* (2006.01)

(52) U.S. Cl.
USPC ..... 381/310; 381/300; 381/307

(58) Field of Classification Search
None
See application file for complete search history.

(56) References Cited

U.S. PATENT DOCUMENTS

| | | | |
|---|---|---|---|
| 1,616,639 | A | 2/1927 | Sprague |
| 1,951,669 | A | 3/1934 | Ramsey |
| 2,062,275 | A | 11/1936 | Blumlein |
| 2,113,976 | A | 4/1938 | Bagno |
| 2,315,248 | A | 3/1943 | De Rosa |
| 2,315,249 | A | 3/1943 | De Rosa |
| 2,461,344 | A | 2/1949 | Olson |
| 3,170,991 | A | 2/1965 | Glasgal |
| 3,180,936 | A | 4/1965 | Schroeder |
| 3,229,038 | A | 1/1966 | Richter |
| 3,246,081 | A | 4/1966 | Edwards |
| 3,249,696 | A | 5/1966 | Van Sickle |
| 3,398,810 | A | 8/1968 | Clark, III |
| 3,612,211 | A | 10/1971 | Clark, III |
| 3,665,105 | A | 5/1972 | Chowning |
| 3,697,692 | A | 10/1972 | Hafler |
| 3,725,586 | A | 4/1973 | Iida |
| 3,745,254 | A | 7/1973 | Ohta et al. |
| 3,757,047 | A | 9/1973 | Ito et al. |

(Continued)

FOREIGN PATENT DOCUMENTS

| | | |
|---|---|---|
| BE | 674341 | 12/1965 |
| DE | 25 55 263 B1 | 2/1977 |

(Continued)

OTHER PUBLICATIONS

International Search Report and Written Opinion issued in application No. PCT/US2012/020102 on May 1, 2012.

(Continued)

*Primary Examiner* — Marlon Fletcher
(74) *Attorney, Agent, or Firm* — Knobbe Martens Olson & Bear LLP

(57) ABSTRACT

A method for processing audio signals can include applying at least one front perspective filter to each of left and right front audio signals to yield filtered left and right front output signals, where the left and right front output signals each drive a front speaker. Moreover, the method can include applying at least one rear perspective filter to each of left and right rear audio signals to yield left and right rear output signals, where the left and right rear output signals each drive a rear speaker to simulate a rear surround sound effect when positioned in front of a listener.

18 Claims, 19 Drawing Sheets

(56) References Cited

U.S. PATENT DOCUMENTS 3,761,631 A 9/1973 Ito et al.
3,772,479 A 11/1973 Hilbert
3,838,217 A 9/1974 Dreyfus
3,849,600 A 11/1974 Ohshima
3,885,101 A 5/1975 Ito et al.
3,892,624 A 7/1975 Shimada
3,921,104 A 11/1975 Gundry
3,925,615 A 12/1975 Nakano
3,943,293 A 3/1976 Bailey
3,970,787 A 7/1976 Searle
4,024,344 A 5/1977 Dolby et al.
4,045,748 A 8/1977 Filliman
4,052,560 A 10/1977 Santmann
4,063,034 A 12/1977 Peters
4,069,394 A 1/1978 Doi et al.
4,090,033 A 5/1978 Silverstein
4,118,599 A 10/1978 Iwahara et al.
4,118,600 A 10/1978 Stahl
4,139,728 A 2/1979 Haramoto et al.
4,166,926 A 9/1979 Sieler
4,177,356 A 12/1979 Jaeger
4,182,930 A 1/1980 Blackmer
4,186,280 A 1/1980 Geiseler
4,191,852 A 3/1980 Nishikawa
4,192,969 A 3/1980 Iwahara
4,204,092 A 5/1980 Bruney
4,209,665 A 6/1980 Iwahara
4,218,583 A 8/1980 Poulo
4,218,585 A 8/1980 Carver
4,219,696 A 8/1980 Kogure et al.
4,237,343 A 12/1980 Kurtin et al.
4,239,937 A 12/1980 Kampmann
4,275,269 A 6/1981 Sugita et al.
4,287,391 A 9/1981 Queen
4,303,800 A 12/1981 DeFreitas
4,306,113 A 12/1981 Morton
4,308,423 A 12/1981 Cohen
4,308,424 A 12/1981 Bice, Jr.
4,309,570 A 1/1982 Carver
4,329,544 A 5/1982 Yamada
4,332,979 A 6/1982 Fischer
4,340,779 A 7/1982 Hashimoto et al.
4,349,698 A 9/1982 Iwahara
4,355,203 A 10/1982 Cohen
4,356,349 A 10/1982 Robinson
4,393,270 A 7/1983 van den Berg
4,394,536 A 7/1983 Shima et al.
4,408,095 A 10/1983 Ariga et al.
4,441,202 A 4/1984 Tong et al.
4,479,235 A 10/1984 Griffis
4,481,662 A 11/1984 Long et al.
4,489,432 A 12/1984 Polk
4,495,637 A 1/1985 Bruney
4,497,064 A 1/1985 Polk
4,503,554 A 3/1985 Davis
4,506,379 A 3/1985 Komatsu
4,542,254 A 9/1985 Santacesaria et al.
4,567,607 A 1/1986 Bruney et al.
4,569,074 A 2/1986 Polk
4,589,129 A 5/1986 Blackmer et al.
4,593,696 A 6/1986 Hochmair et al.
4,594,610 A 6/1986 Patel
4,594,729 A 6/1986 Weingartner
4,594,730 A 6/1986 Rosen
4,618,985 A 10/1986 Pfeiffer
4,622,691 A 11/1986 Tokumo et al.
4,641,343 A 2/1987 Holland et al.
4,648,117 A 3/1987 Kunugi et al.
4,661,981 A 4/1987 Henrickson et al.
4,696,036 A 9/1987 Julstrom
4,696,040 A 9/1987 Doddington et al.
4,698,842 A 10/1987 Mackie et al.
4,703,502 A 10/1987 Kasai et al.
4,703,505 A 10/1987 Seiler et al.
4,707,858 A 11/1987 Fette
4,739,514 A 4/1988 Short et al.
4,743,906 A 5/1988 Fullerton
4,748,669 A 5/1988 Klayman
4,790,014 A 12/1988 Watanabe et al.
4,802,228 A 1/1989 Silverstein et al.
4,817,149 A 3/1989 Myers
4,819,269 A 4/1989 Klayman
4,827,516 A 5/1989 Tsukahara et al.
4,829,572 A 5/1989 Kong
4,831,652 A 5/1989 Anderson et al.
4,836,329 A 6/1989 Klayman
4,837,824 A 6/1989 Orban
4,841,572 A 6/1989 Klayman
4,852,172 A 7/1989 Taguchi
4,856,064 A 8/1989 Iwamatsu
4,862,502 A 8/1989 Griesinger
4,866,774 A 9/1989 Klayman
4,866,776 A 9/1989 Kasai et al.
4,882,752 A 11/1989 Lindman et al.
4,882,758 A 11/1989 Uekawa et al.
4,888,809 A 12/1989 Knibbeler
4,891,560 A 1/1990 Okumura et al.
4,891,841 A 1/1990 Bohn
4,896,360 A 1/1990 Knight
4,910,779 A 3/1990 Cooper et al.
4,922,539 A 5/1990 Rajasekaran et al.
4,933,768 A 6/1990 Ishikawa
4,933,973 A 6/1990 Porter
4,945,568 A 7/1990 Willems
4,953,213 A 8/1990 Tasaki et al.
4,955,058 A 9/1990 Rimkeit et al.
4,969,192 A 11/1990 Chen et al.
4,979,216 A 12/1990 Malsheen et al.
5,012,519 A 4/1991 Adlersberg et al.
5,018,205 A 5/1991 Takagi et al.
5,033,092 A 7/1991 Sadaie
5,042,068 A 8/1991 Scholten et al.
5,046,097 A 9/1991 Lowe et al.
5,058,169 A 10/1991 Temmer
5,067,157 A 11/1991 Ishida et al.
5,103,481 A 4/1992 Iseda et al.
5,105,462 A 4/1992 Lowe et al.
5,124,667 A 6/1992 Chevallier
5,133,013 A 7/1992 Munday
5,146,507 A 9/1992 Satoh et al.
5,148,488 A 9/1992 Chen et al.
5,150,113 A 9/1992 Blüthgen
5,150,413 A 9/1992 Nakatani et al.
5,175,793 A 12/1992 Sakamoto et al.
5,177,329 A 1/1993 Klayman
5,180,990 A 1/1993 Ohkuma
5,181,251 A 1/1993 Schultheiss et al.
5,195,167 A 3/1993 Bahl et al.
5,199,075 A * 3/1993 Fosgate ..... 381/307
5,208,493 A 5/1993 Lendaro et al.
5,208,860 A 5/1993 Lowe et al.
5,216,718 A 6/1993 Fukuda
5,228,085 A 7/1993 Aylward
5,243,656 A 9/1993 Tanida et al.
5,251,260 A 10/1993 Gates
5,255,326 A 10/1993 Stevenson
5,280,543 A 1/1994 Yokoyama et al.
5,319,713 A 6/1994 Waller, Jr. et al.
5,325,435 A 6/1994 Date et al.
5,333,201 A 7/1994 Waller, Jr.
5,359,665 A 10/1994 Werrbach
5,371,799 A 12/1994 Lowe et al.
5,386,082 A 1/1995 Higashi
5,390,364 A 2/1995 Webster et al.
5,400,405 A 3/1995 Petroff
5,420,929 A 5/1995 Geddes et al.
5,452,362 A 9/1995 Burward-Hoy
5,459,813 A 10/1995 Klayman
5,491,685 A 2/1996 Klein et al.
5,533,129 A 7/1996 Gefvert
5,546,465 A 8/1996 Kim
5,572,591 A 11/1996 Numazu et al.
5,579,396 A 11/1996 Iida
5,596,931 A 1/1997 Rossler et al.

| | | | | |
|---|---|---|---|---|
| 5,638,452 | A | 6/1997 | Waller, Jr. | |
| 5,661,808 | A | 8/1997 | Klayman | |
| 5,668,885 | A | 9/1997 | Oda | |
| 5,677,957 | A | 10/1997 | Hulsebus | |
| 5,734,724 | A | 3/1998 | Kinoshita | |
| 5,742,688 | A | 4/1998 | Ogawa | |
| 5,742,689 | A | 4/1998 | Tucker et al. | |
| 5,771,295 | A | 6/1998 | Waller, Jr. | |
| 5,771,296 | A | 6/1998 | Unemura | |
| 5,784,468 | A | 7/1998 | Klayman | |
| 5,799,094 | A | 8/1998 | Mouri | |
| 5,822,438 | A | 10/1998 | Sekine et al. | |
| 5,841,879 | A | 11/1998 | Scofield et al. | |
| 5,850,453 | A | 12/1998 | Klayman et al. | |
| 5,870,480 | A | 2/1999 | Griesinger | |
| 5,872,851 | A | 2/1999 | Petroff | |
| D408,818 | S | 4/1999 | Klayman | |
| 5,892,830 | A | 4/1999 | Klayman | |
| 5,896,456 | A | 4/1999 | Desper | |
| 5,912,976 | A | 6/1999 | Klayman et al. | |
| 5,930,373 | A | 7/1999 | Shashoua et al. | |
| 5,930,375 | A | 7/1999 | East et al. | |
| 5,970,152 | A | 10/1999 | Klayman | |
| 5,999,630 | A | 12/1999 | Iwamatsu | |
| 6,009,179 | A | 12/1999 | Wood | |
| 6,134,330 | A | 10/2000 | De Poortere et al. | |
| D435,842 | S | 1/2001 | Klayman | |
| 6,236,730 | B1 | 5/2001 | Cowieson et al. | |
| 6,281,749 | B1 | 8/2001 | Klayman et al. | |
| 6,285,767 | B1 | 9/2001 | Klayman | |
| 6,385,320 | B1 | 5/2002 | Lee | |
| 6,430,301 | B1 | 8/2002 | Petrovic | |
| 6,498,857 | B1 * | 12/2002 | Sibbald | 381/310 |
| 6,504,933 | B1 | 1/2003 | Chung | |
| 6,507,658 | B1 * | 1/2003 | Abel et al. | 381/17 |
| 6,587,565 | B1 * | 7/2003 | Choi | 381/98 |
| 6,590,983 | B1 | 7/2003 | Kraemer | |
| 6,597,791 | B1 | 7/2003 | Klayman | |
| 6,614,914 | B1 | 9/2003 | Rhoads et al. | |
| 6,624,873 | B1 | 9/2003 | Callahan, Jr. et al. | |
| 6,647,389 | B1 | 11/2003 | Fitch et al. | |
| 6,694,027 | B1 | 2/2004 | Schneider | |
| 6,718,039 | B1 | 4/2004 | Klayman et al. | |
| 6,721,425 | B1 * | 4/2004 | Aylward | 381/22 |
| 6,737,957 | B1 | 5/2004 | Petrovic et al. | |
| 6,760,448 | B1 | 7/2004 | Gundry | |
| 6,766,176 | B1 | 7/2004 | Gupta et al. | |
| 6,766,305 | B1 | 7/2004 | Fucarile et al. | |
| 6,931,134 | B1 * | 8/2005 | Waller et al. | 381/27 |
| 6,937,737 | B2 * | 8/2005 | Polk, Jr. | 381/300 |
| 6,993,480 | B1 | 1/2006 | Klayman | |
| 7,031,474 | B1 | 4/2006 | Yuen et al. | |
| 7,043,031 | B2 | 5/2006 | Klayman et al. | |
| 7,076,071 | B2 | 7/2006 | Katz | |
| 7,152,032 | B2 | 12/2006 | Suzuki et al. | |
| 7,177,431 | B2 | 2/2007 | Davis et al. | |
| 7,200,236 | B1 * | 4/2007 | Klayman et al. | 381/18 |
| 7,212,872 | B1 | 5/2007 | Smith et al. | |
| 7,277,767 | B2 | 10/2007 | Yuen et al. | |
| 7,451,093 | B2 | 11/2008 | Kraemer | |
| 7,467,021 | B2 | 12/2008 | Yuen et al. | |
| 7,490,044 | B2 * | 2/2009 | Kulkarni | 704/501 |
| 7,492,907 | B2 | 2/2009 | Klayman et al. | |
| 7,522,733 | B2 | 4/2009 | Kraemer et al. | |
| 7,555,130 | B2 | 6/2009 | Klayman et al. | |
| 7,636,443 | B2 | 12/2009 | Klayman | |
| 7,778,427 | B2 | 8/2010 | Klayman | |
| 7,920,711 | B2 * | 4/2011 | Takashima et al. | 381/307 |
| 7,974,417 | B2 * | 7/2011 | Kim et al. | 381/1 |
| 7,974,425 | B2 * | 7/2011 | Fincham | 381/307 |
| 8,027,494 | B2 | 9/2011 | Kimura et al. | |
| 8,050,434 | B1 * | 11/2011 | Kato et al. | 381/310 |
| 8,295,496 | B2 * | 10/2012 | Kulkarni | 381/17 |
| 8,335,330 | B2 * | 12/2012 | Usher | 381/300 |
| 2001/0020193 | A1 | 9/2001 | Teramachi et al. | |
| 2002/0129151 | A1 | 9/2002 | Yuen et al. | |
| 2002/0157005 | A1 | 10/2002 | Brunk et al. | |
| 2003/0031333 | A1 * | 2/2003 | Cohen et al. | 381/303 |
| 2003/0169886 | A1 * | 9/2003 | Boyce | 381/1 |
| 2003/0185418 | A1 | 10/2003 | Linnartz et al. | |
| 2005/0078851 | A1 | 4/2005 | Jones et al. | |
| 2006/0062395 | A1 | 3/2006 | Klayman et al. | |
| 2006/0093152 | A1 | 5/2006 | Thompson et al. | |
| 2006/0126851 | A1 | 6/2006 | Yuen et al. | |
| 2007/0025559 | A1 * | 2/2007 | Mihelich et al. | 381/59 |
| 2007/0025560 | A1 * | 2/2007 | Asada | 381/61 |
| 2007/0025842 | A1 | 2/2007 | Bouru | |
| 2007/0061026 | A1 | 3/2007 | Wang | |
| 2008/0008324 | A1 | 1/2008 | Sim et al. | |
| 2008/0019533 | A1 | 1/2008 | Noguchi et al. | |
| 2008/0247553 | A1 * | 10/2008 | Katayama | 381/17 |
| 2008/0247555 | A1 * | 10/2008 | Avendano et al. | 381/27 |
| 2009/0268917 | A1 * | 10/2009 | Croft, III | 381/17 |
| 2010/0316224 | A1 | 12/2010 | Lau | |
| 2012/0076308 | A1 | 3/2012 | Kuech et al. | |
| 2012/0237037 | A1 * | 9/2012 | Ninan et al. | 381/17 |

FOREIGN PATENT DOCUMENTS

| | | | |
|---|---|---|---|
| DE | 33 31 352 | A1 | 3/1985 |
| EP | 0 094 762 | A2 | 11/1983 |
| EP | 0 095 902 | A1 | 12/1983 |
| EP | 0 097 982 | A2 | 1/1984 |
| EP | 0 097 982 | A3 | 12/1985 |
| EP | 0 312 406 | A2 | 4/1989 |
| EP | 0 320 270 | A2 | 6/1989 |
| EP | 0 354 517 | A2 | 2/1990 |
| EP | 0 357 402 | A2 | 3/1990 |
| EP | 0 367 569 | A2 | 5/1990 |
| EP | 0 357 402 | A3 | 2/1991 |
| EP | 0 312 406 | A3 | 3/1991 |
| EP | 0 367 569 | A3 | 7/1991 |
| EP | 0 526 880 | A2 | 2/1993 |
| EP | 0 546 619 | A2 | 6/1993 |
| EP | 0 526 880 | A3 | 1/1994 |
| EP | 0 546 619 | A3 | 4/1994 |
| EP | 0 637 191 | A2 | 2/1995 |
| EP | 0 637 191 | A3 | 8/1995 |
| EP | 0 699 012 | A2 | 2/1996 |
| EP | 0 729 287 | A2 | 8/1996 |
| EP | 0 756 437 | B1 | 1/1997 |
| EP | 1320281 | A2 | 6/2003 |
| FI | 35 014 | | 2/1966 |
| GB | 2 016 248 | A | 9/1979 |
| GB | 2 073 977 | A | 10/1981 |
| GB | 2 154 835 | A | 2/1985 |
| GB | 2 277 855 | A | 11/1994 |
| JP | 43-12585 | | 5/1968 |
| JP | 40-29936 | | 10/1975 |
| JP | 58-146200 | | 8/1983 |
| JP | 58-144989 | | 9/1983 |
| JP | 59-27692 | | 2/1984 |
| JP | 61-33600 | | 2/1986 |
| JP | 61-166696 | | 10/1986 |
| JP | 62097500 | A2 | 5/1987 |
| JP | 63-42000 | | 3/1988 |
| JP | 64-49100 | | 2/1989 |
| JP | 3139100 | A | 6/1991 |
| JP | 550900 | | 7/1993 |
| JP | 053-00596 | | 11/1993 |
| JP | 06269097 | | 9/1994 |
| JP | 07-007798 | | 1/1995 |
| JP | 09-224300 | | 8/1997 |
| JP | 3208529 | B2 | 9/2001 |
| JP | 3686989 | | 6/2005 |
| WO | WO 87/06090 | | 10/1987 |
| WO | WO 91/19407 | | 12/1991 |
| WO | WO 93/02503 | | 2/1993 |
| WO | WO 94/16538 | | 7/1994 |
| WO | WO 96/16548 | | 6/1996 |
| WO | WO 96/34509 | | 10/1996 |
| WO | WO 97/42789 | | 11/1997 |
| WO | WO 98/20709 | | 5/1998 |
| WO | WO 98/21915 | | 5/1998 |
| WO | WO 98/46044 | | 10/1998 |
| WO | WO 99/26454 | | 5/1999 |
| WO | WO 01/61987 | | 8/2001 |

OTHER PUBLICATIONS

International Search Report and Written Opinion issued in application No. PCT/US2012/020099 on May 4, 2012.
Potard et al., "*Decorrelation Techniques for the Rendering of Apparent Sound Source Width in 3D Audio Displays*", Proc. of the 7th Int. Conference on Digital Audio Effects (DAFx'04), Naples, Italy, Oct. 5-8, 2004, pp. 28-284.
Kendall, "*The Decorrelation of Audio Signals and It's Impact on Spatial Imagery*", Computer Music Journal, 19(4):71-87 (1995).
International Search Report issued in application No. PCT/US97/19825 on Mar. 10, 1998.
U.S. Appl. No. 13/342,743, filed Jan. 3, 2012, Kraemer et al.
U.S. Appl. No. 13/342,758, filed Jan. 3, 2012, Kraemer et al.
U.S. Appl. No. 12/363,530, filed Jan. 30, 2009, Klayman et al.
Allison, R., "The Loudspeaker/Living Room System," Audio, Nov. 1971, pp. 18-22.
Boney, L., et al., "Digital Watermarks for Audio Signals," Proceedings of the International Conference on Multimedia Computing Systems, Los Alamitos, CA, U.S., Jun. 17, 1996, pp. 473-480.
Clarkson, P., et al., "Envelope Expansion Methods for Speech Enhancement," J. Acoust. Soc. Am., vol. 89, No. 3, Mar. 1991, pp. 1378-1382.
Coetzee, H.J., et al., "An LSP Based Speech Quality Measure," 1999 IEEE, ICASSP-89, vol. 1, May 1989, pp. 596-599.
Conway, R.J., et al., "Adaptive Postfiltering Applied to Speech in Noise," Midwest Symposium on Circuits and Systems, Aug. 14-16, 1989, pp. 101-104.
Conway, R.J., et al., "Evaluation of a Technique Involving Processing with Feature Extraction to Enhance the Intelligibility of Noise-Corrupted Speech," IECON '90 Conference of IEEE Industrial Electronics Society, Pacific Grove, CA, vol. 1, Nov. 27-30, 1990, pp. 28-33.
Davies, Jeff, et al., "Squeeze Me, Stretch Me: the DC 24 Users Guide," Rane Note 130 [online]. Rane Corporation, 1993 [retrieved Apr. 25, 2005], Retrieved from the Internet: URL:http://www.rane.com/pdf/note130.pdf, pp. 2-3.
Eargle, J., "Multichannel Stereo Matrix Systems; An Overview," Journal of the Audio Engineering Society, pp. 552-558.
Ishihara, M., "A New Analog Signal Processor for a Stereo Enhancement," IEEE Transactions on Consumer Electronics, vol. 37, No. 4, Nov. 1991, pp. 806-813.
Kaufman, Richard J., "Frequency Contouring for Image Enhancement," Audio, Feb. 1985, pp. 34-39.
Kurozumi, K., et al., "A New Sound Image Broadening Control System Using a Correlation Coefficient Variation Method," Electronics and Communications in Japan, vol. 67-A, No. 3, Mar. 1984, pp. 204-211.
Lim, J. .S., "Enhancement and Bandwidth Compression of Noisy Speech," Proceedings of the IEEE, vol. 67, No. 12, Dec. 1979, pp. 1568-1604.
Philips Components, "Integrated Circuits Data Handbook: Radio, audio and associated systems, Bipolar, MOS CA3089 to TDA1510," Oct. 7, 1987, pp. 103-110.
Schroeder, M.R., "An Artificial Stereophonic Effect Obtained from a Single Audio Signal," Journal of the Audio Engineering Society, vol. 6, No. 2, Apr. 1958, pp. 74-79.
Stevens, S., et al., "Chapter 5: The Two-Earned Man," Sound and Hearing, 1965, pp. 98-106, and 196.
Sundberg, J., "The Acoustics of the Singing Voice," The Physics of Music, 1978, pp. 16-23.
Vaughan, D., "How We Hear Direction," Audio, Dec. 1983, pp. 51-55.
Wilson, Kim, "Ac-3 Is Here! But Are You Ready to Pay the Price?," Home Theater, Jun. 1995, pp. 60-65.
International Search Report and Preliminary Examination Report for International Application No. PCT/US97/06995, filed Apr. 28, 1997.
International Search Report and Preliminary Examination Report mailed Mar. 10, 1998; for International Application No. PCT/US97/19825, filed Oct. 31, 1997.
International Search Report Preliminary Examination Report for International Application No. PCT/US99/20090, filed Sep. 2, 1999.
International Search Report and Preliminary Examination Report for International Application No. PCT/US00/27323, filed Oct. 4, 2000.
International Search Report and Written Opinion for International Application No. PCT/US2005/015291, filed Apr. 29, 2005.
International Search Report and Written Opinion mailed Feb. 20, 2008 for International Application No. PCT/US07/008052.

* cited by examiner

MULTI-CHANNEL AUDIO ENHANCEMENT SYSTEM

CROSS-REFERENCE TO RELATED APPLICATIONS

This application claims priority under 35 U.S.C. §120 as a continuation application of U.S. patent application Ser. No. 11/963,679, filed Dec. 21, 2007, which claims priority under 35 U.S.C. §119(e) from U.S. Provisional Application No. 60/876,248 filed Dec. 21, 2006, entitled "Multi-Channel Audio Enhancement System," which is hereby incorporated herein by reference in its entirety.

BACKGROUND

1. Technical Field

Certain embodiments of this disclosure relate generally to audio enhancement systems.

2. Description of the Related Technology

Increasing technical capabilities and user preferences have led to a wide variety of audio recording and playback systems. Audio systems have developed beyond the simpler stereo systems having separate left and right recording/playback channels to what are commonly referred to as surround sound systems. Surround sound systems are generally designed to provide a more realistic playback experience for the listener by providing sound sources that originate or appear to originate from a plurality of spatial locations arranged about the listener, generally including sound sources located behind the listener.

A surround sound system will frequently include a center channel, at least one left channel, and at least one right channel adapted to generate sound generally in front of the listener. Surround sound systems will also generally include at least one left surround source and at least one right surround source adapted for generation of sound generally behind the listener. Surround sound systems can also include a low frequency effects (LFE) channel, sometimes referred to as a subwoofer channel, to improve the playback of low frequency sounds. As one particular example, a surround sound system having a center channel, a left front channel, a right front channel, a left surround channel, a right surround channel, and an LFE channel can be referred to as a 5.1 surround system. The number 5 before the period indicates the number of non-bass speakers present and the number 1 after the period indicates the presence of a subwoofer.

SUMMARY OF SOME EMBODIMENTS

In certain embodiments, a method for processing audio signals can include receiving left and right front audio signals, where the left and right front audio signals each include information about a front spatial position of a sound source relative to a listener. The method can also include receiving left and right rear audio signals, where the left and right rear audio signals can each include information about a rear spatial position of a sound source relative to a listener. In addition, the method can include applying at least one front perspective filter to each of the left and right front audio signals to yield filtered left and right front output signals, where the left and right front output signals each drive a front speaker. Moreover, the method can include applying at least one rear perspective filter to each of the left and right rear audio signals to yield left and right rear output signals, where the left and right rear output signals each drive a rear speaker to simulate a rear surround sound effect when positioned in front of a listener.

A system can also be provided for processing audio signals. The system can include, for example, left and right front audio signals each having information about a front spatial position of a sound source relative to a listener. The system can also include left and right rear audio signals each having information about a rear spatial position of a sound source relative to a listener. In addition, the system can include at least one front perspective filter that filters each of the left and right front audio signals to yield filtered left and right front output signals, where the left and right front output signals each drive a front speaker. The system also includes, in some implementations, at least one rear perspective filter that filters each of the left and right rear audio signals to yield left and right rear output signals, where the left and right rear output signals each drive a rear speaker to simulate a rear surround sound effect when positioned in front of or facing a listener.

Moreover, in certain embodiments a system for processing audio signals includes left and right front audio signals each having information about a front spatial position of a sound source relative to a listener, and left and right rear audio signals each having information about a rear spatial position of a sound source relative to a listener. In certain embodiments, the system further includes a dialog clarity module that enhances dialog in at least one of (a) the left and right front audio signals and (b) a center front audio signal. The system can also include at least one front perspective filter that filters each of the left and right front audio signals to yield filtered left and right front output signals, where the left and right front output signals each drive a front speaker, and at least one rear perspective filter that filters each of the left and right rear audio signals to yield left and right rear output signals, where the left and right rear output signals each drive a rear speaker to simulate a rear surround sound effect when positioned facing a listener. Moreover, the system can include a bass management module that can enhance a bass response associated with at least the filtered left and right front output signals and selectively apply crossover filters to one or more of the filtered left and right front output signals and the filtered left and right rear output signals.

Neither this summary nor the following detailed description purports to define the inventions disclosed herein. The inventions disclosed herein are defined by the claims.

DETAILED DESCRIPTION OF SOME EMBODIMENTS

Figure 1:
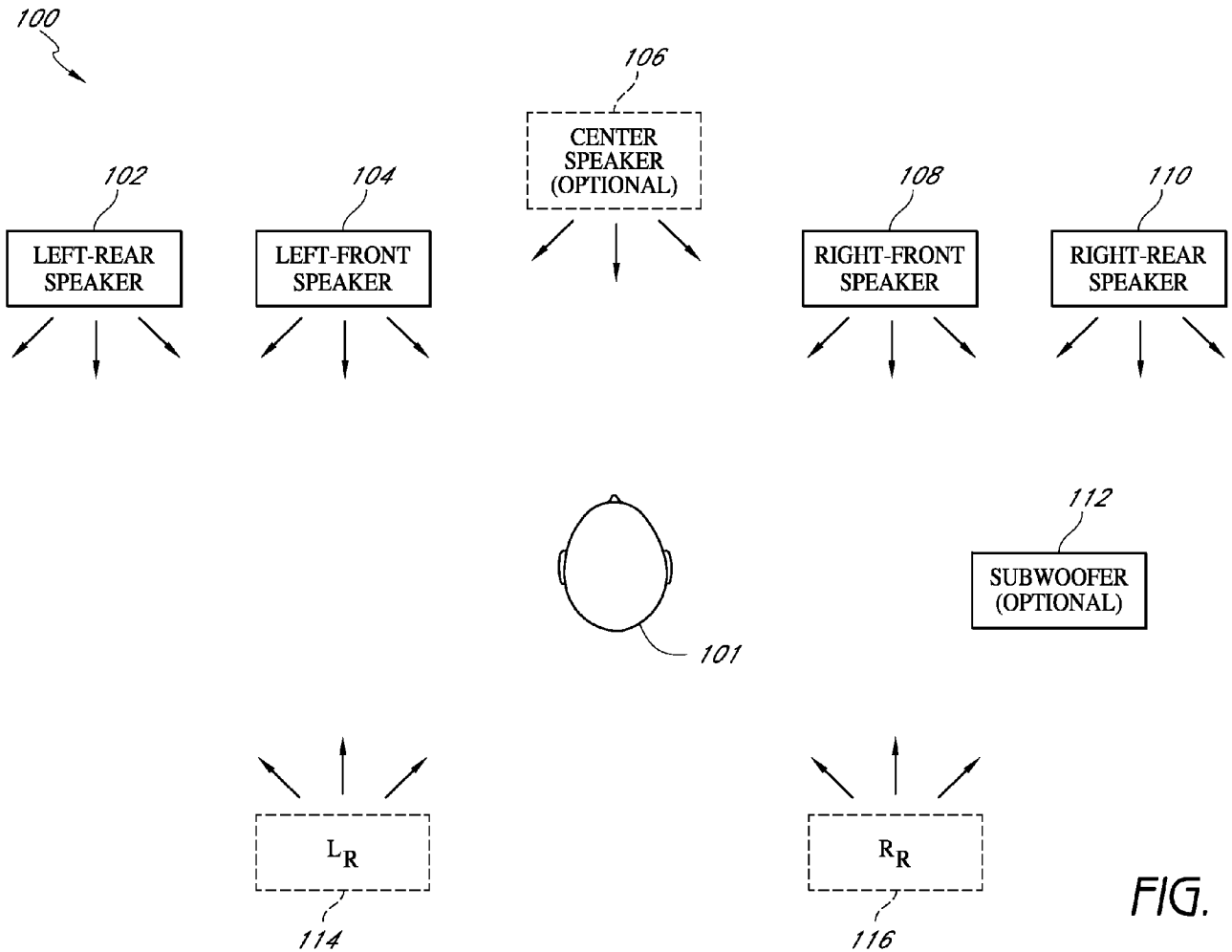
FIG. 1 illustrates an example listening situation where a listener is placed in front of multiple speakers.

Generally, the more speakers in a surround sound system, the greater is the cost of the system. Systems have therefore been developed to create a virtual surround sound environment using two front speakers representing left and right front channels. Subwoofers have also been used with such systems. An example of one such system is disclosed in U.S. Pat. No. 5,912,976 to Klayman et al., titled "Multi-Channel Audio Enhancement System for Use in Recording and Playback and Methods for Providing Same," issued Jun. 15, 1999 ("the Klayman patent"), the disclosure of which is hereby incorporated by reference in its entirety. While systems such as those described in the Klayman patent can provide excellent virtual surround sound results, some listeners of such systems might not perceive virtual surround sound at all times.

It can therefore be desirable to provide additional rear surround speakers with such audio systems. Adding surround speakers also has drawbacks, however. For example, placing speakers at the rear of a listener can require extensive, time-consuming wiring. Placement of such speakers can also be awkward in listening areas with limited space, such as in apartments or the like. Thus, certain embodiments describe systems and methods for providing surround speakers that are placed in front of or facing a listener. Advantageously, certain processing algorithms can be used to create a perception that the outputs of the surround speakers are coming from virtual speakers placed behind a listener. Because the speakers are actually placed in front of the listener, certain embodiments of such speakers do not necessarily require the extensive wiring that is typically used for surround speakers. In addition, the surround speakers can be placed in less obtrusive locations, such as near the front speakers, while still providing a surround sound experience.

The features of these systems and methods will now be described with reference to the drawings summarized above. Throughout the drawings, reference numbers are re-used to indicate correspondence between referenced elements. The drawings, associated descriptions, and specific implementation are provided to illustrate embodiments of the inventions disclosed herein and not to limit the scope of the inventions disclosed herein.

In addition, signal processing algorithms described herein are not limited to any particular sequence, and the blocks or states relating thereto can be performed in other sequences that are appropriate. For example, described blocks or states may be performed in an order other than that specifically disclosed, or multiple blocks or states may be combined in a single block or state. Moreover, the various modules, blocks, and components of the systems described herein can be implemented as software applications, modules, or hardware components on one or more computers or embedded systems. While the various modules, components, and blocks are illustrated separately, they may share some or all of the same underlying logic or code.

FIG. 1 shows an example situation 100 where a listener 101 is listening to sound from a multi-speaker device such as headphones, a television, a computer speaker system, other audio and/or audiovisual equipment, combinations of the same, and the like. In the depicted embodiment six speakers are shown, including a left rear (surround) speaker 102, a left front speaker 104, an optional center speaker 106, a right front speaker 108, a right rear (surround) speaker 110, and an optional subwoofer 112.

In addition, two virtual speakers 114, 116 are also shown, including a left rear or surround virtual speaker 114 and a right rear or surround virtual speaker 116. The virtual speakers 114, 116 in certain embodiments represent sound that the listener 101 perceives as coming from behind or surrounding the listener. In certain embodiments, the sound emanating from the virtual speakers 114, 116 is provided by the left rear speaker 102 and the right rear speaker 110, respectively. These speakers 102, 110 are advantageously able to produce sound perceived as virtual speakers 114, 116 while positioned in front of or facing the listener. In certain embodiments, the outputs of the left and right rear speakers 102, 110 create the virtual speakers 114, 116 by being processed using perspective filters, as described in further detail below.

In addition to the surround sound enhancements of the virtual speakers 114, 116, further enhancements of the sound can be provided. For example, enhancement of dialog present in a television show, movie, or other audio can be provided. Bass audio frequencies can be enhanced in certain embodiments. In addition, if a subwoofer is present, bass frequencies can be localized on the subwoofer. Examples of these and other audio enhancements are described in further detail below.

Figure 2:
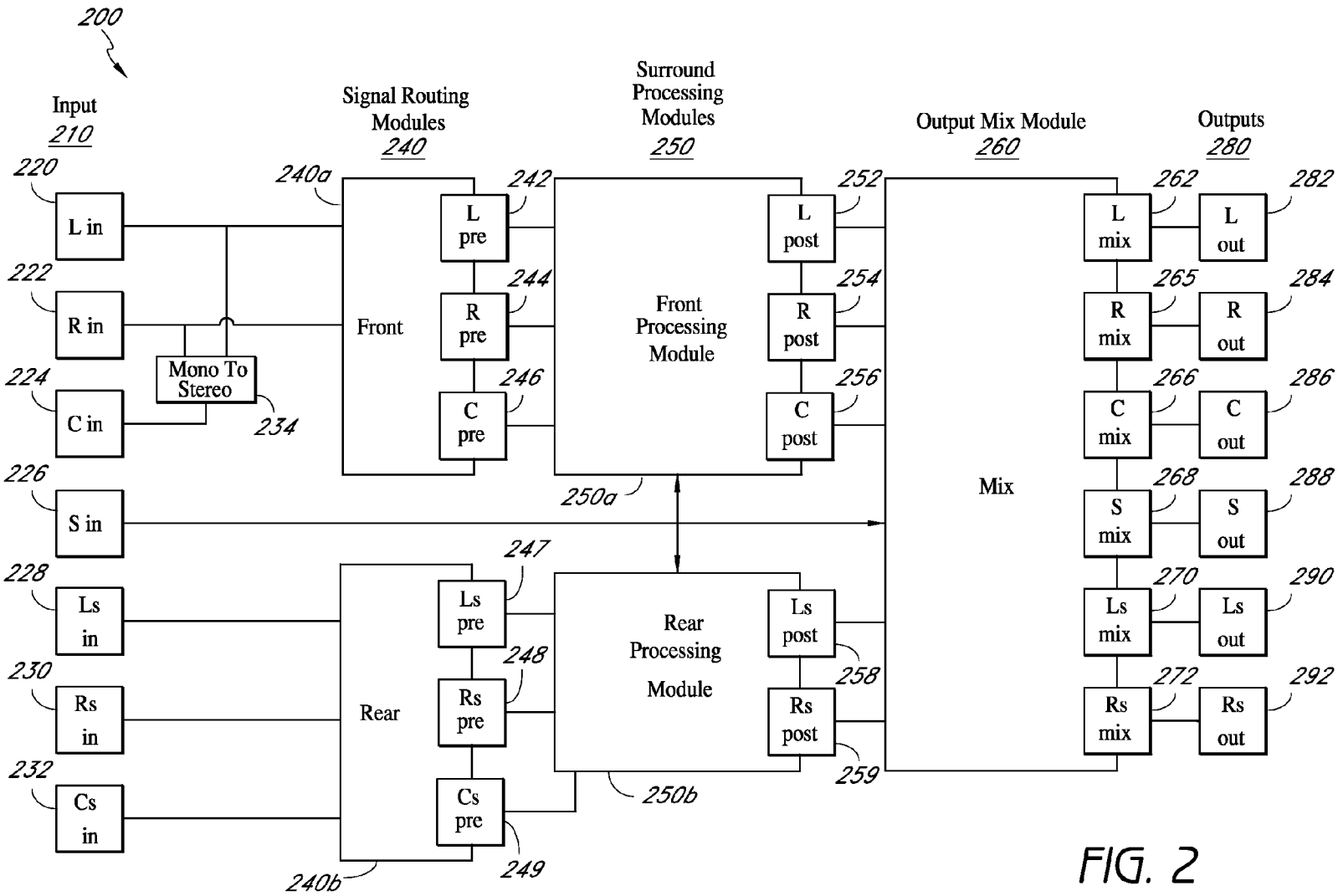
FIG. 2 illustrates an embodiment of an audio system for use in the example listening situation of FIG. 1.

FIG. 2 illustrates an embodiment of an audio system 200. The audio system 200 can receive a variable number of inputs 210 and produce a variable number of outputs 280. The audio system 200 advantageously enables additional surround speakers to be placed in front of a listener while generating virtual speakers perceived by the listener.

Various inputs 210 are provided to the audio system 200. In certain embodiments, the number of inputs 210 can range from one input to seven inputs. In other words, in certain embodiments inputs ranging from a mono input to a full 6.1 surround set of inputs can be provided. A full range of 6.1 surround sound inputs 210 are shown in the depicted embodiment, including a left front input 220, a right front input 222, a center front input 224, a subwoofer input 226, a left surround input 228, a right surround input 230, and a center surround input 232. However, in certain embodiments, the audio system 200 can receive fewer or more inputs 210 than those shown.

Certain of the inputs 210 can include Circle Surround or other matrix surround encoded inputs in some implementations. Matrix surround-encoded inputs can be inputs provided by a 5-2-5 matrix surround encoder, which matrix encodes five-channel audio onto two audio channels. These two channels can be efficiently transmitted to a decoder in the audio system, an example of which is described below with respect to FIG. 5. In certain embodiments, the encoded audio can be efficiently transmitted to the decoder using any of the popular compression schemes available, such as Mp3, RealAudio, WMA, combinations of the same, and the like.

As described above, the inputs 210 can include a single or mono input 210 in some implementations. For example, a mono input 210 can be provided as the center input 224 in one embodiment. A mono-to-stereo conversion module 234 can convert the mono input 210 into a stereo signal which is routed to the inputs 220 and 222. The mono-to-stereo conversion module 234 in certain embodiments can use the mono-to-stereo conversion techniques described in U.S. patent application Ser. No. 10/734,776, entitled "Systems and Methods of Spatial Image Enhancement of a Sound Source," filed Dec. 12, 2003, the disclosure of which is hereby incorporated by reference in its entirety.

In addition to providing for a variable number of inputs 210, the audio system 200 can provide a variable number of outputs 280. As shown, these outputs 280 can include up to a left (front) output 282, a right (front) output 284, a center (front) output 286, a subwoofer output 288, a left (rear) surround output 290, and a rear (rear) surround output 292. In certain embodiments, fewer or more than all the depicted outputs 280 shown are provided by the audio system 200. The number of outputs 280 provided can be adjusted by a listener.

For convenience, the remainder of this specification will refer to the inputs 210 and outputs 280 as having input modes and outputs modes, respectively. These input and output modes will be referred to using an "x_y_z" convention, where the "x" refers to the number of front inputs 210 or outputs 280, the "y" refers to the number of surround inputs 210 or outputs 280, and the "z" refers to the presence of a subwoofer. Thus, for example, if three front inputs 210 are provided and two rear inputs 210 are provided, then the input mode could be described as 3__2__0. As another example, if two front outputs 280, two surround outputs 280, and a subwoofer output 280 output are provided, the output mode could be represented as 2__2__1.

The following Table illustrates example input mode configurations available in certain embodiments of the audio system 200. The Table refers to the inputs 220 through 232 as L, C, R, Sub, Ls, Cs, and Rs, respectively. Table 1 also describes a Passive Matrix mode, which provides $L_t$ and $R_t$ signals. The "t" subscript refers to "total," indicating that each $L_t$ and $R_t$ signal includes encoded information for possibly multiple channels. Table 1 also describes a 3__2_BSDigital mode, which includes signals provided by a BS Digital Broadcaster, which, in certain embodiments, do not include a discretely-encoded center channel. In addition, Table 1 describes a PL2_Music mode for signals decoded with Dolby Pro Logic II and a Circle Surround mode for inputs received from a Circle Surround decoder.

TABLE 1

| Input Modes | | | | | | | | |
|---|---|---|---|---|---|---|---|---|
| Input Mode | Inputs 210 (Channels) | | | | | | | |
| 1_0_1 | | C | | | | | / | Sub |
| 2_0_1 | L | | R | | | | / | Sub |
| 2_1_1 | L | | R | / | | Cs | / | Sub |
| 2_2_1 | L | | R | / | Ls | Rs | / | Sub |
| 3_0_1 | L | C | R | / | | | | Sub |
| 3_1_1 (Also for signals decoded with Dolby Pro Logic) | L | C | R | / | | Cs | / | Sub |
| 3_2_1 (Also for signals decoded with Dolby Pro Logic II in Movie mode) | L | C | R | / | Ls | Rs | / | Sub |
| 3_3_1 Passive Matrix encoded signals (e.g., encoded using Circle Surround techniques) | $L_t$ | C | $R_t$ | / | Ls | Cs Rs | / | Sub |
| 3_2_BSDigital | L | C | R | / | Ls | Rs | / | Sub |
| PL2_Music (For signals decoded with Dolby Pro Logic II in Music mode) | L | C | R | / | Ls | Rs | / | Sub |

TABLE 1-continued

| Input Modes | | | | | | | | |
|---|---|---|---|---|---|---|---|---|
| Input Mode | Inputs 210 (Channels) | | | | | | | |
| Circle Surround (For signals decoded with Circle Surround) | L | C | R | / | $L_{(s)}$ | $R_{(s)}$ | / | Sub |

The following Table 2 illustrates example output modes available in certain embodiments of the audio system 200. The Table refers to the outputs 282 through 292 as L, C, R, Sub, Ls, Cs, and Rs, respectively.

TABLE 2

| Output Modes | |
|---|---|
| Output Mode | Outputs 280 (Channels) Used |
| 2_2_0 | L, R, Ls, Rs |
| 2_2_1 | L, R, Ls, Rs, Sub |
| 3_2_0 | L, R, C, Ls, Rs |
| 3_2_1 | L, R, C, Ls, Rs, Sub |

Continuing, in certain embodiments the left input 220, the right input 222, and the center input 224 are provided to a front signal routing module 240*a*. Likewise, in certain embodiments the left surround input 228, the right surround input 230, and the center surround input 232 are provided to a rear signal routing module 240*b*. The front signal routing module 240*a* can include components for combining or routing certain of the front inputs 220, 222, and 224 depending on a selected input mode. Likewise, the rear signal routing module 240*b* can include components for combining certain of the inputs 228, 230, and 232 depending on the input mode.

The front and rear signal routing modules 240 can further adjust an input gain of the inputs 210 in certain embodiments to increase headroom for further signal processing. In addition, one or both of the signal routing modules 240 can include a passive matrix decoder that decodes Circle Surround inputs. An example passive matrix decoder is shown and described below with respect to FIG. 5.

The front signal routing module 240*a* provides a left pre-output 242, a right pre-output 244, and a center pre-output 246 to a front surround processing module 250*a*. Similarly, the signal routing module 240*b* provides a left surround pre-output 247, a right surround pre-output 248, and a center surround pre-output 249 to a rear surround processing module 250*a*. In certain embodiments, the front and rear surround processing modules 250 include one or more perspective filters that produce or enhance surround sound effects of the pre-outputs 242 through 249. The front and rear surround processing modules 250 can also process the subwoofer input 226 in certain embodiments. More detailed embodiments of the surround processing modules 250 are described below with respect to FIGS. 6 and 7.

The front processing module 250*a* provides a left post 242 output, a right post output 254, and a center post output 256 to an output mix module 260. The rear processing module 250*b* likewise provides a left surround post output 258 and a right surround post output 259 to the output mix module 260.

The output mix module 260 includes components for mixing one or more of the post outputs 252, 254, and 256. The output mix module 260 in certain embodiments also passes the left and right surround post outputs 258, 259 without mixing these outputs. Additionally, in certain embodiments, the output mix module 260 applies a user-adjustable gain to the left and right surround post outputs 258, 259. This user-adjustable gain can be applied to adjust the amount of surround effect provided.

The output mix module 260 provides a left mix output 262, a right mix output 265, a center mix output 266, a subwoofer mix output 268, a left surround mix output 270, and a right surround mix output 272. These mix outputs in certain embodiments are provided as the outputs 280, which in more detail include outputs 282, 284, 286, 288, 290, and 292, respectively.

Figure 3:
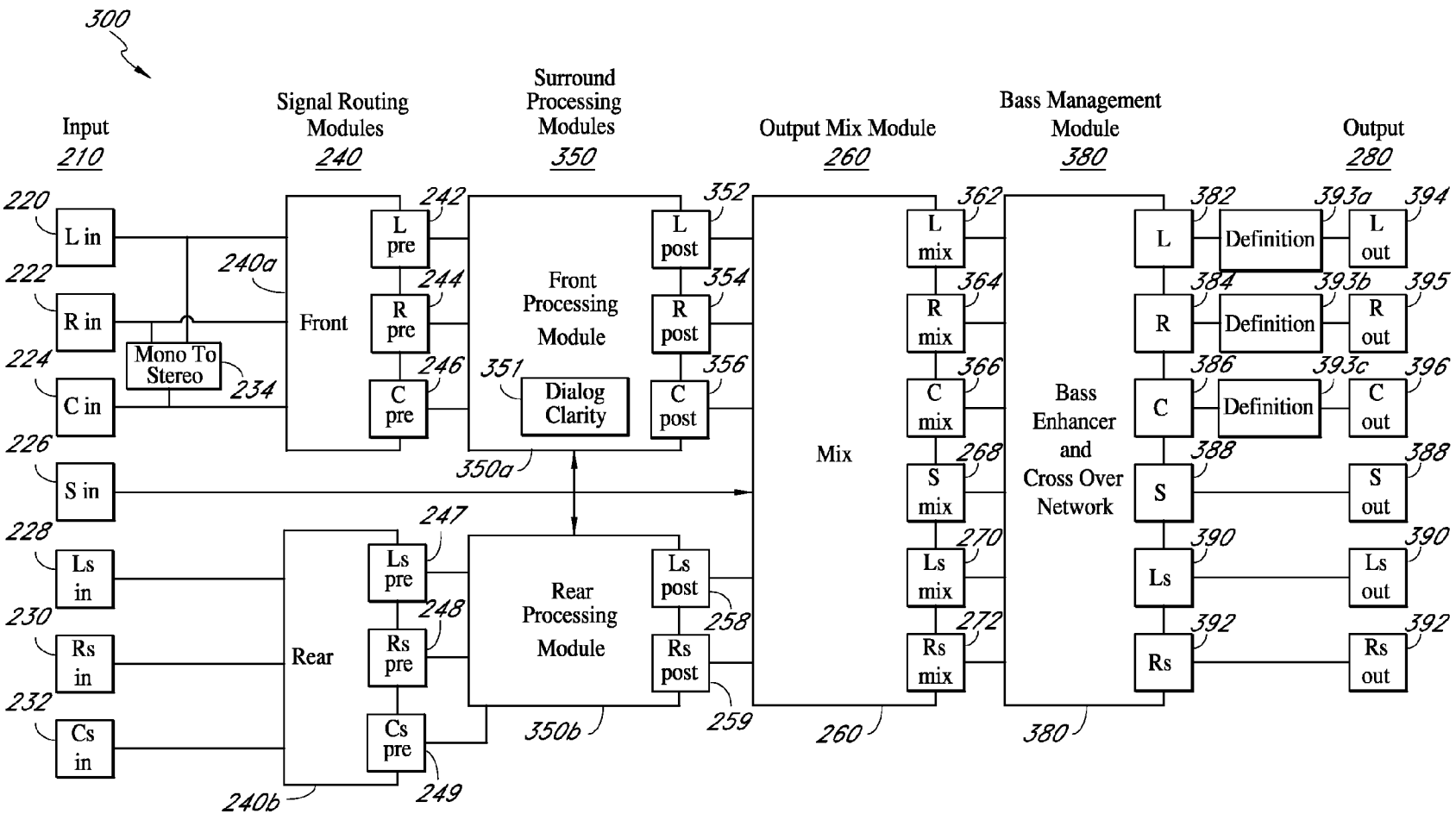
FIG. 3 illustrates another embodiment of an audio system for use in the example listening situation of FIG. 1.

Turning to FIG. 3, another embodiment of an audio system 300 is shown. The audio system 300 in certain embodiments includes all of the functionality of the audio system 200. For instance, the audio system 300 includes the inputs 210, the signal routing modules 240, the surround processing modules 250, and the output mix module 260. The audio system 300 also provides additional audio enhancement modules including a dialog clarity module 351, a bass management module 380, and definition modules 393.

The dialog clarity module 351 of certain embodiments includes one or more dialog clarity filters for enhancing the clarity of dialog. The dialog clarity module 351 can beneficially enhance the clarity of dialog found in movies, television shows, other audio and/or audiovisual productions, and the like. Certain implementations of the dialog clarity module 351 enhance dialog by emphasizing formants in speech. An example dialog clarity module 351 is described below with respect to FIG. 10. In addition, in certain embodiments the dialog clarity module 351 can use some or all of the dialog clarification techniques disclosed in U.S. Pat. No. 5,459,813 to Klayman, titled "Public Address Intelligibility System," issued Oct. 17, 1995, the disclosure of which is hereby incorporated by reference in its entirety.

The bass management module 300, in certain embodiments, includes a bass enhancer for optionally enhancing low frequency audio information provided on the front mix outputs 262, 264, and 266 and/or the subwoofer mix output 268. The bass management module 380 can also include a crossover network of filters that can be optionally applied to one or more of the mix outputs 262 through 272. The crossover network can be used, for instance, when a subwoofer output 397 is used. This crossover network can apply filters to the mix outputs 262 through 272 to beneficially localize low frequency information on the subwoofer channel. The bass enhancement and crossover features of the bass management module 300 can be turned on or off by a listener in certain embodiments. Further details of the bass enhancer and crossover network are described with respect to FIGS. 11 and 12 below.

The bass management module 380 passes a subwoofer output 388, a left surround output 391, and a right surround output 392 as a subwoofer output 397, a left surround output 398, and a right surround output 399. The bass management module 380 also optionally passes a left output 382, a right output 384 and a center output 386 to one or more definition modules 393.

The definition modules 393, in certain embodiments, include one or more filters for emphasizing certain high frequency regions of audio signals. These filters can improve the perception of clarity and of acoustic space in the left, right, and/or center outputs 382, 384, and 386. One definition module 393 can receive all three outputs 382, 384, and 386. Alternatively, as shown, three separate definition modules 393 can each receive an output 382, 384, and 386. More detailed embodiments of the definition module 393 are described below with respect to FIG. 13.

Figure 4:
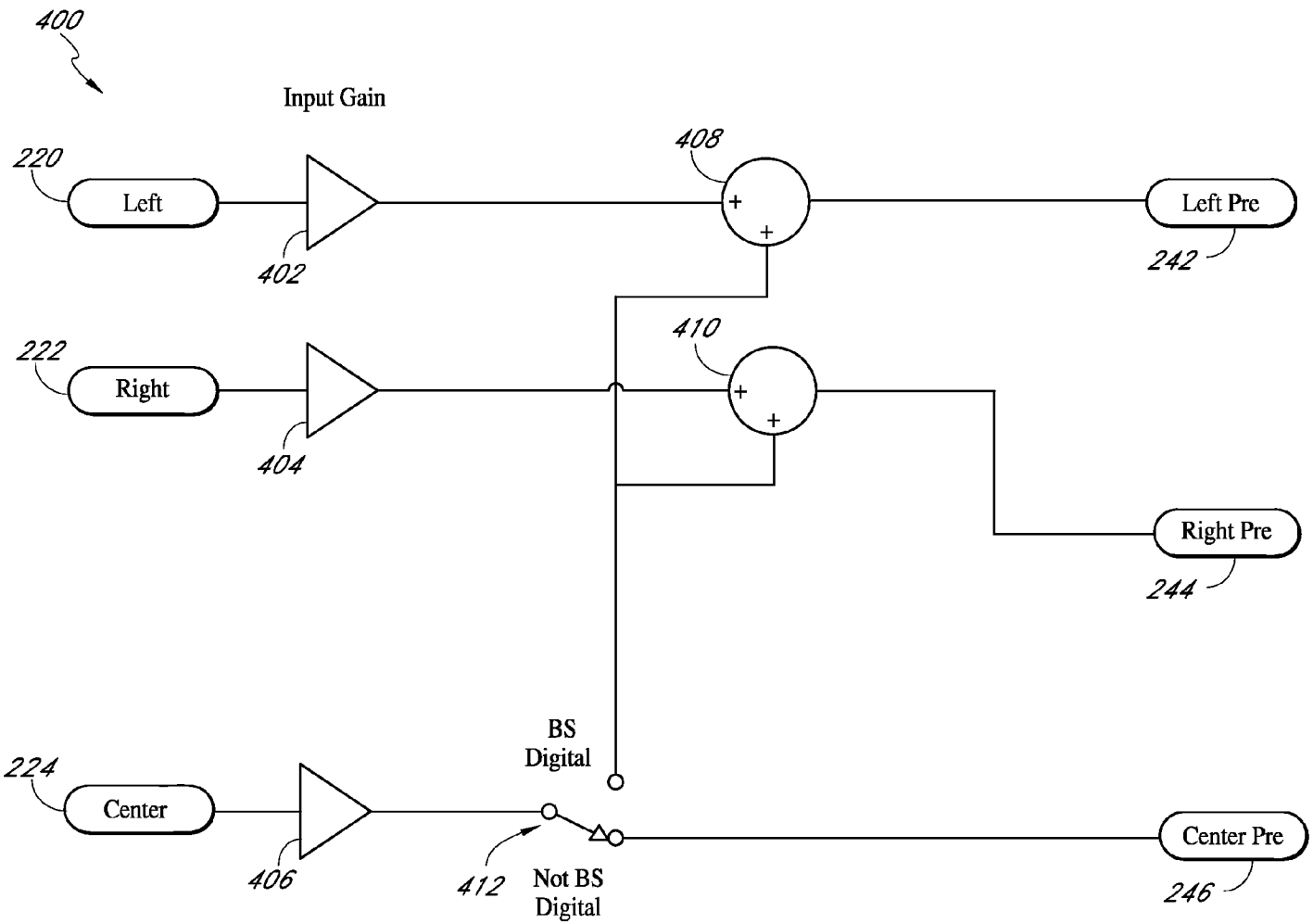
FIGS. 4 and 5 illustrate embodiments of signal routing modules of the audio systems of FIGS. 2 and 3.

Turning to FIG. 4, an example embodiment of a signal routing module 400 is shown. The signal routing module 400 in one embodiment is an implementation of the front signal routing module 240*a* described above with respect to FIGS. 2 and 3. In addition to other features, the signal routine module 400 includes components for combining or routing certain of the front inputs 220, 222, and 224 depending on a selected input mode.

The signal routing module 400 receives the left input 220, the right input 222, and the center input 224. These inputs are each provided to input gain blocks 402, 404, and 406, respectively. The input gain blocks 402, 404, and 406 in various implementations control the signal level of the inputs 220, 222, and 224. The input gain blocks 402, 404, and 406 can, for example, attenuate one or more the signal inputs 220, 222, and 224 to provide additional headroom for further processing.

For example, in one embodiment, the input gain blocks 402, 404, and 406 can have a gain value ranging from 0 to 1. An exemplary value of the input gain blocks 402, 404, and 406 is 0.5, representing a one-half or 6 decibel (dB) attenuation. However, other values and ranges may be chosen. The values of the input gain blocks 402, 404, and 406 are equal in one embodiment but can vary from one another in other embodiments.

The output of the input gain block 402 is provided to sum block 408. Likewise, the output of the input gain block 404 is provided to sum block 410. The output of input gain block 406 is provided to switch 412. If a BS Digital mode is selected, the output of the switch 412 is provided to both sum blocks 408, 410. The sum block 408 then sums the input from the input gain block 402 and the input gain block 406 and provides the left pre output 242. The sum block 410 sums the input from the input gain block 404 and the input gain block 406 and provides the left pre output 242.

If, however, BS Digital mode is not selected, the switch 412 passes the output of the input gain block 406 as the center pre output 246 and does not pass an output to the sum blocks 408 and 410. Accordingly, the sum blocks 408, 410 pass their respective inputs to the left pre output 242 and the right pre output 244, respectively.

Figure 5:
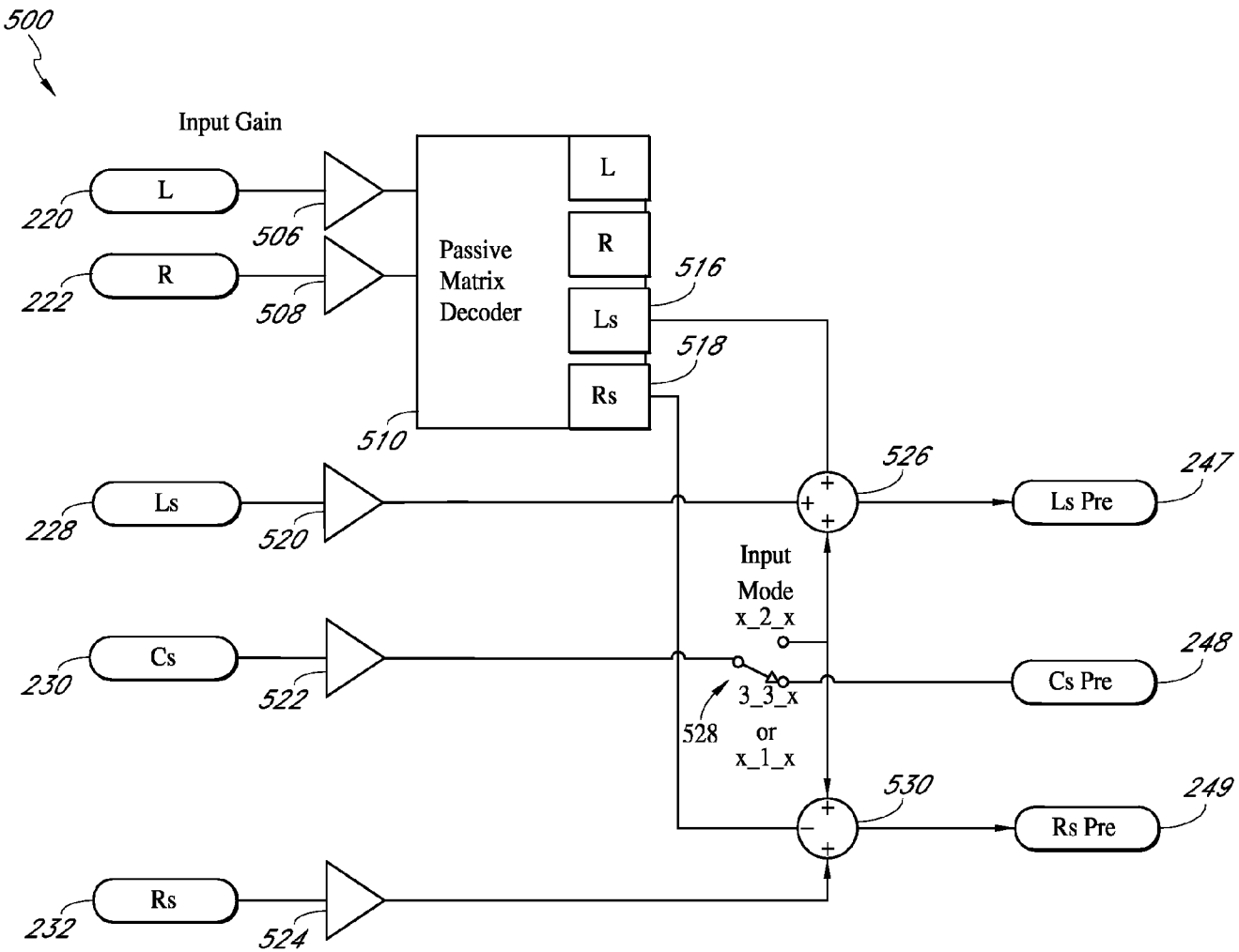

FIG. 5 illustrates another example embodiment of a signal routing module 500. The signal routing module 500 in one embodiment is an implementation of the rear signal routing module 240*b* described above with respect to FIGS. 2 and 3. In addition to other features, the signal routine module 500 includes components for combining or routing certain of the rear inputs 228, 230, and 232 depending on a selected input mode.

In embodiments where matrix surround-encoded inputs are provided, the signal routine module 500 also includes components for combining or routing the matrix surround-encoded inputs. For example, matrix surround-encoded left and right (total) inputs 220, 222. These inputs are provided to input gain blocks 506, 508 respectively, which in certain embodiments include the same functionality of the input gain blocks described above with respect to FIG. 4. The outputs of the input gain blocks 506 and 508 are provided to a passive matrix decoder 510. The passive matrix decoder uses these outputs to synthesize a left surround input 516 and a right surround input 518, which are provided to sum blocks 526 and 530, respectively.

The inputs 220 and 222 can be used in some non-Circle Surround implementations. For instance, if the input mode includes no surround content (e.g., 2_0_1 or 3_0_1), the left and right inputs 220, 222 can be provided to the respective input gain blocks 506, 508, which provide outputs to the passive matrix decoder 510. The passive matrix decoder 510 can then be used to synthesize the left surround input 516 and the right surround input 518.

The left surround input 228, center surround input 230, and right surround input 2323 are also provided to respective input gain blocks 520, 522, and 524, which can function in the manner described above. The output of the input gain block 520 is provided to a sum block 526, the output of the input gain block 522 is provided to switch 528, and the output of input gain block 524 is provided to a sum block 530.

If the input mode is x__2_x, the sum block 526 also receives the output of the input gain block 522. The sum block 526 sums the output of the input gain block 520, the output 516, and optionally the output of the input gain block 522 to produce the left surround pre output 247. The sum block 530 also receives the output of the input gain block 522 if the input mode is 3__3_x or x__1_x. The sum block 530 then sums the output of the input gain block 524, the output 518, and optionally the output of the input gain block 522 to produce the right surround pre output 249. Additionally, if the input mode is 3__3_x or x__1_x, the switch 528 provides the output of the input gain block 522 as the center surround pre output 248.

Figure 6:
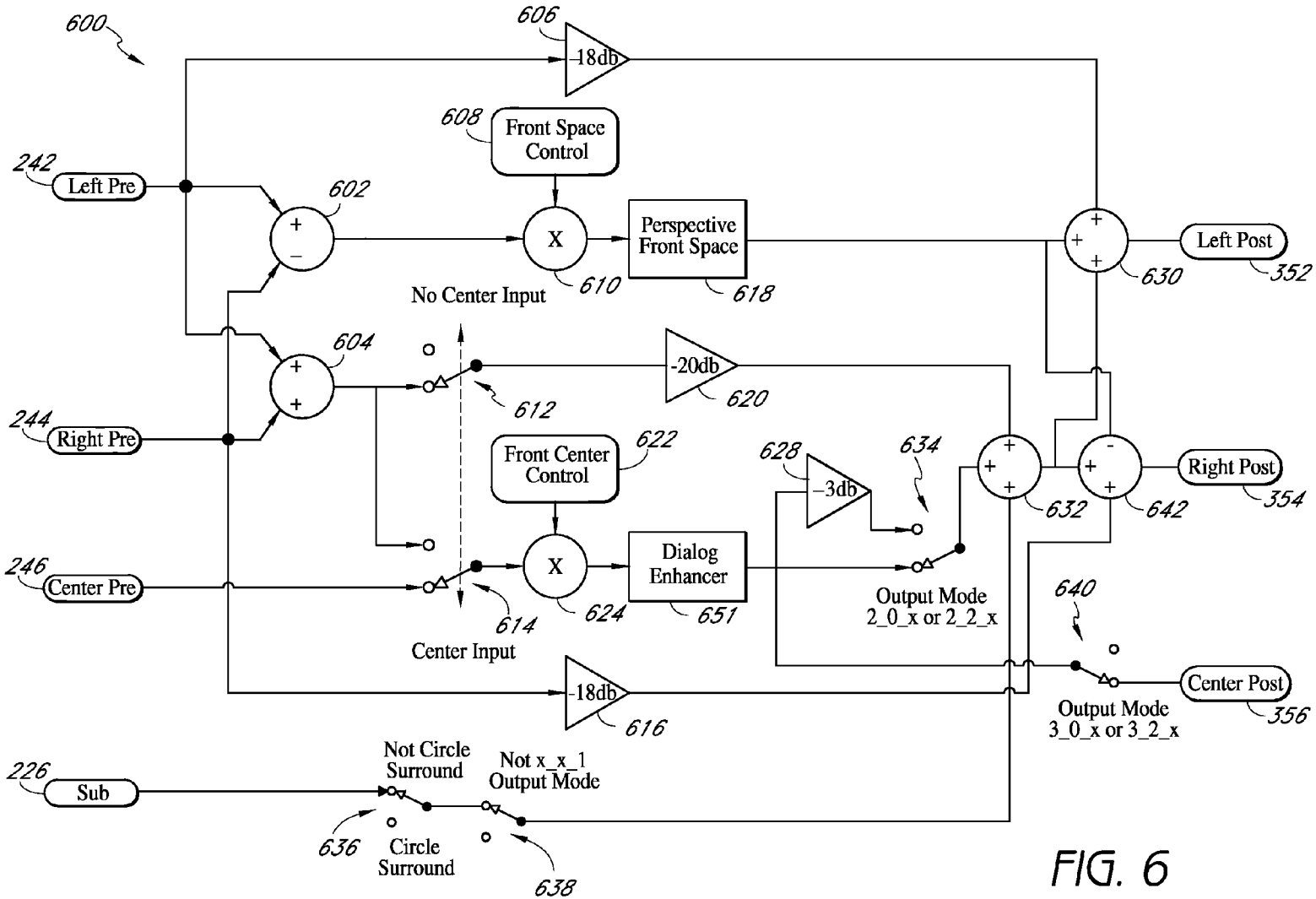
FIGS. 6 and 7 illustrate embodiments of surround processing modules of the audio systems of FIGS. 2 and 3.

FIG. 6 illustrates an embodiment of a front surround processing module 600. In certain embodiments the front surround processing module 600 is a more detailed example implementation of the front surround processing module 350*a*. In certain embodiments, the front surround processing module 600 produce or enhances surround sound effects of the pre-outputs 242, 244, and 246. In addition, the front surround processing module 600 can process the subwoofer input 226 in certain embodiments.

The front surround processing module 350*a* receives the left pre output 242, the right pre output 244, the center pre output 246, and the subwoofer input 226 from a signal routing module. The left pre output 242 and the right pre output 244 are summed at block 602 and at sum block 604. The output of the sum block 602 is provided to a multiply block 610, which multiplies the output of the sum block 602 with a front space control input 608. The front space control input 608 is provided in some implementations for testing and customization purposes. The front space control input 608 can include a −3 to −12 dB value in certain embodiments, which effectively reduces the output of the sum block 602 by −3 to −12 dB. However, other values can be chosen for the front space control input 608.

The output of the multiply block 610 is provided to a perspective front space module 618. The perspective front space module 618 includes one or more perspective filters, which process the output of the multiply block 610 to provide or enhance a front surround sound effect. An embodiment of the perspective front space module is described in greater detail below with respect to FIG. 8. The output of the perspective front space module 618 is provided to sum block 630.

Referring again to the left pre output 242, this output 242 is also provided to a gain block 606, which in the depicted embodiment includes a −18 dB attenuation. This value may be varied in other implementations. The output of the gain block 606 is provided to the sum block 630. Similarly, the right pre output 244 is also provided to a gain block 616, which in the depicted embodiment also includes a −18 dB attenuation. This value also may be varied in other implementations. The output of the gain block 616 is provided to a sum block 642.

The output of the sum block 604 is provided to switches 612 and 614. In the depicted embodiment, if a center input is included in the audio system 200 or 300, the switches 612, 614 provide the center pre output 246 to multiply block 624. Additionally, in such an embodiment, the output of the sum block 604 is provided to gain block 620, which has an example value of −20 dB. The output of the gain block 620 is further provided to a sum block 632. However, if a center input is not included, the switches 612, 614 provide the output of the sum block 604 to the multiply block 624.

The multiply block 624 multiples the center pre output 246 with a front center control input 622. The front center control input 622 is provided in some implementations for testing and customization purposes. In certain embodiments, the front center control input 622 has a value of −4 dB, although other values may be chosen in other embodiments. The output of the multiply block 624 is provided to a dialog enhancer module 651 for enhancing dialog on the center pre output 246 or the combined left and right pre outputs 242, 244. The dialog enhancer module 641 can have the same or similar functionality as the dialog enhancer module 351 described above with respect to FIG. 3. In addition, a more detailed example implementation of the dialog enhancer module 651 is shown in greater detail below with respect to FIG. 10.

The output of the dialog enhancer module 651 is provided to a gain block 628, which in the depicted embodiment has an example value of −3 dB. The output of the gain block is provided to switch 634. Likewise, the output of the dialog enhancer 651 is also provided directly to switch 634. If the output mode is 2__0_x or 2__2_x, then the switch 634 provides the output from the dialog enhancer 351 directly to sum block 632. If, however, the output mode is neither 2__0_x or 2__2_x, then the switch 634 instead provides the output of the gain block 628 to the sum block 632.

The output of the dialog enhancer module 651 is also provided to switch 640. If the output mode is 3__0_x or 3__2_x, then the switch 640 provides the output of the dialog enhancer 651 as the center post output 356. Otherwise, the switch 640 does not pass the output of the dialog enhancer module 651 as the center post output 356.

The subwoofer input 226 is provided to switch 636. If Circle Surround mode is not in use, then the output of the switch 636 is provided to switch 638. Otherwise, the output of the switch 636 is not provided to the switch 638. The switch 638 provides an output if the system is not in x_x__1 output mode.

The output of the switch 638 is provided to sum block 632, which provides a summed output to the sum block 642. The output of the sum block 642 provided as the right post output 354. The output of the sum block 630 is the left post output 352.

Figure 7:
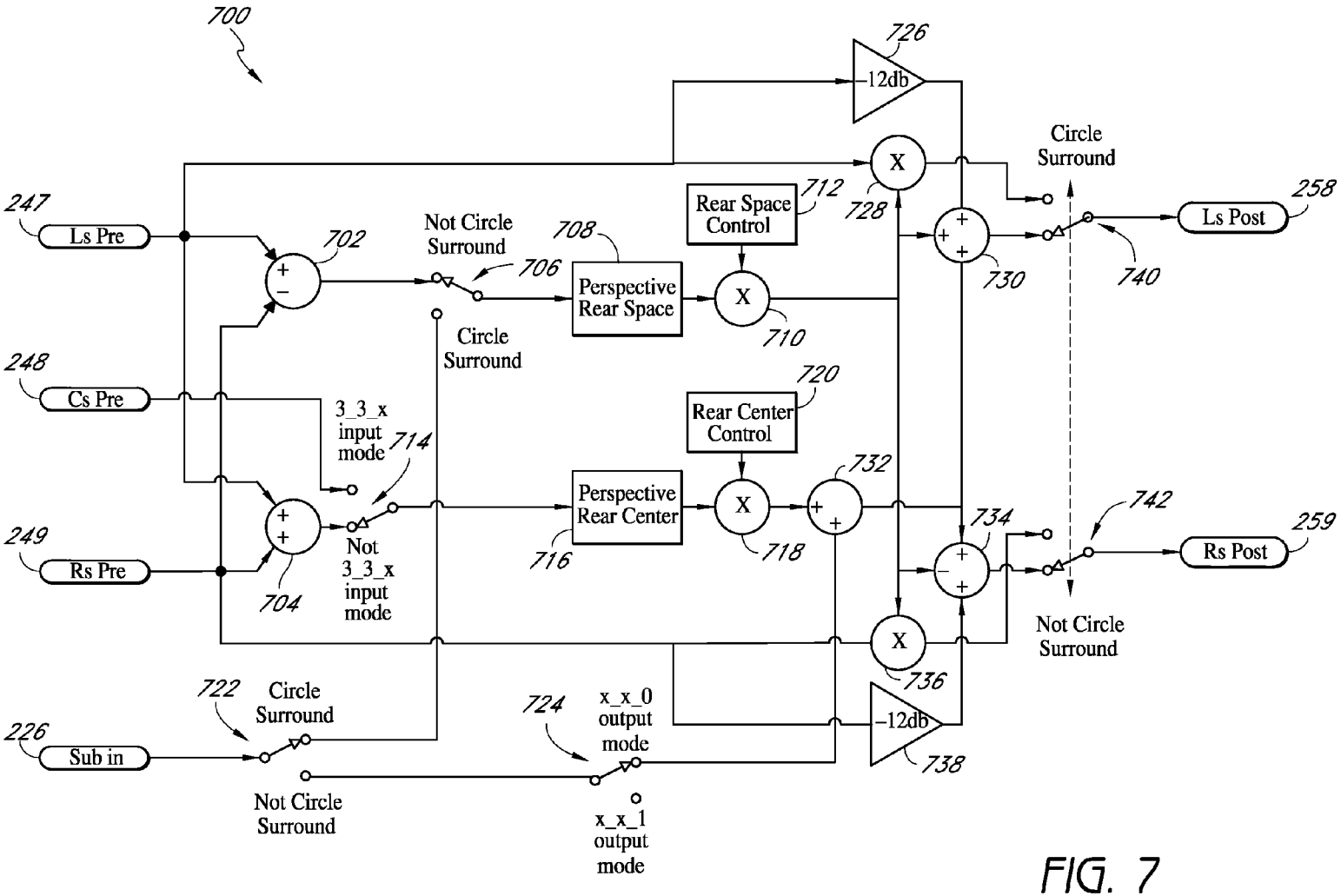

FIG. 7 illustrates an embodiment of a rear surround processing module 700. In certain embodiments the rear surround processing module 700 is a more detailed example implementation of the rear surround processing module 250*b*. In certain embodiments, the rear surround processing module 700 produce or enhances surround sound effects of the pre-outputs 247, 248, and 249. In addition, the rear surround processing module 700 can process the subwoofer input 226 in certain embodiments.

In an embodiment, the rear surround processing module 250*b* receives the left surround pre output 247, the center surround pre output 248, the right surround pre output 249, and the subwoofer input 226. The left surround pre output 247 and the right surround pre output 249 are provided to sum block 702, where the right surround pre output 249 is subtracted from the left surround 247.

The output of the sum block 702 is provided to a switch 706. If Circle Surround-encoded inputs are provided, then the switch 706 does not pass the output of the sum block 702.

Otherwise, the switch 706 passes the output of the sum block 702 to a perspective rear space module 708. The perspective rear space module 708 includes one or more perspective filters for providing or enhancing a rear surround sound effect. A more detailed example embodiment of the perspective rear space module 708 is described below with respect to FIG. 9.

The output of the perspective rear space module 708 is provided to multiply block 710, where it is multiplied with a rear space control input 712. The rear space control input 712 is provided in some implementations for testing and customization purposes. Example values for the rear space control input 712 can range from −11 dB to +9 dB, depending on input mode used. However, other values and ranges can be used in alternative embodiments. The output of the multiply block 710 is provided to a multiply block 728, a multiply block 736, and a sum block 730.

The left and right surround pre outputs 247, 249 are also provided to sum block 704, where the two outputs 247, 249 are summed together. The output of the sum block 704 is provided to switch 714. If the input mode is 3_3_x, then the switch 714 passes the center surround pre output 248 to a perspective rear center module 716. However, if the input mode is not 3_3_x, then the switch 714 instead passes the output of the sum block 704 to the perspective rear center module 716.

The perspective rear center module 716 in certain embodiments includes the same functionality as the perspective rear space module 708. The output of the perspective rear center module 716 is provided to multiply block 718, which multiplies this output with a rear center control input 720. The rear center control input 720 is provided in some implementations for testing and customization purposes. The rear center control input 720 can have a range of values, such as −11 dB to +9 dB, in certain embodiments. The output of the multiply block 718 is provided to sum block 732. The sum block 732 in turn provides an output to sum blocks 730 and 734.

The left surround pre output 247 is also provided to a gain block 726. The value of the gain block 726 in the depicted embodiment is −12 dB, although other values may be chosen. The output of the gain block 726 is provided to sum block 730. The left surround pre output 247 is also provided to multiply block 728, where the output 247 is multiplied with the output of the multiply block 710. The outputs of both the sum block 730 and the multiply block 728 are provided to a switch 740. If Circle Surround-encoded inputs are used, then the switch 740 passes the output of the multiply block 728 as the left surround post output 258. Otherwise, switch 740 passes the output of the sum block 730 as the left surround post output 258.

The right surround pre output 249 is similarly passed to a gain block 738, which in the depicted embodiment has a −12 dB gain, although other values may be chosen. The output of the gain block 738 is provided to the sum block 734. The right surround pre output block 249 is also provided to the multiply block 736. The outputs of the sum block 734 and the multiply block 736 are provided to a switch 742. If Circle Surround-encoded inputs are used, then the switch 742 passes the output of the multiply block 736 as the right surround post output 259. Otherwise, the switch 742 passes the output of the sum block 734 as the right surround post output 259.

The subwoofer input 226 is provided to a switch 722. If Circle Surround-encoded inputs are used, then the output of the switch 722 is passed to the switch 706. The switch 706 passes this output to the perspective rear space module 708 in place of the output of the sum block 702 if Circle Surround-encoded inputs are used. If Circle Surround-encoded inputs are not used, the output of the switch 722 is instead passed to a switch 724. If the output mode is x_x_0 or x_x_1, then the output of the switch 724 is passed to the sum block 732. Otherwise, the output of the switch 724 is not passed by the switch 724.

Figure 8:
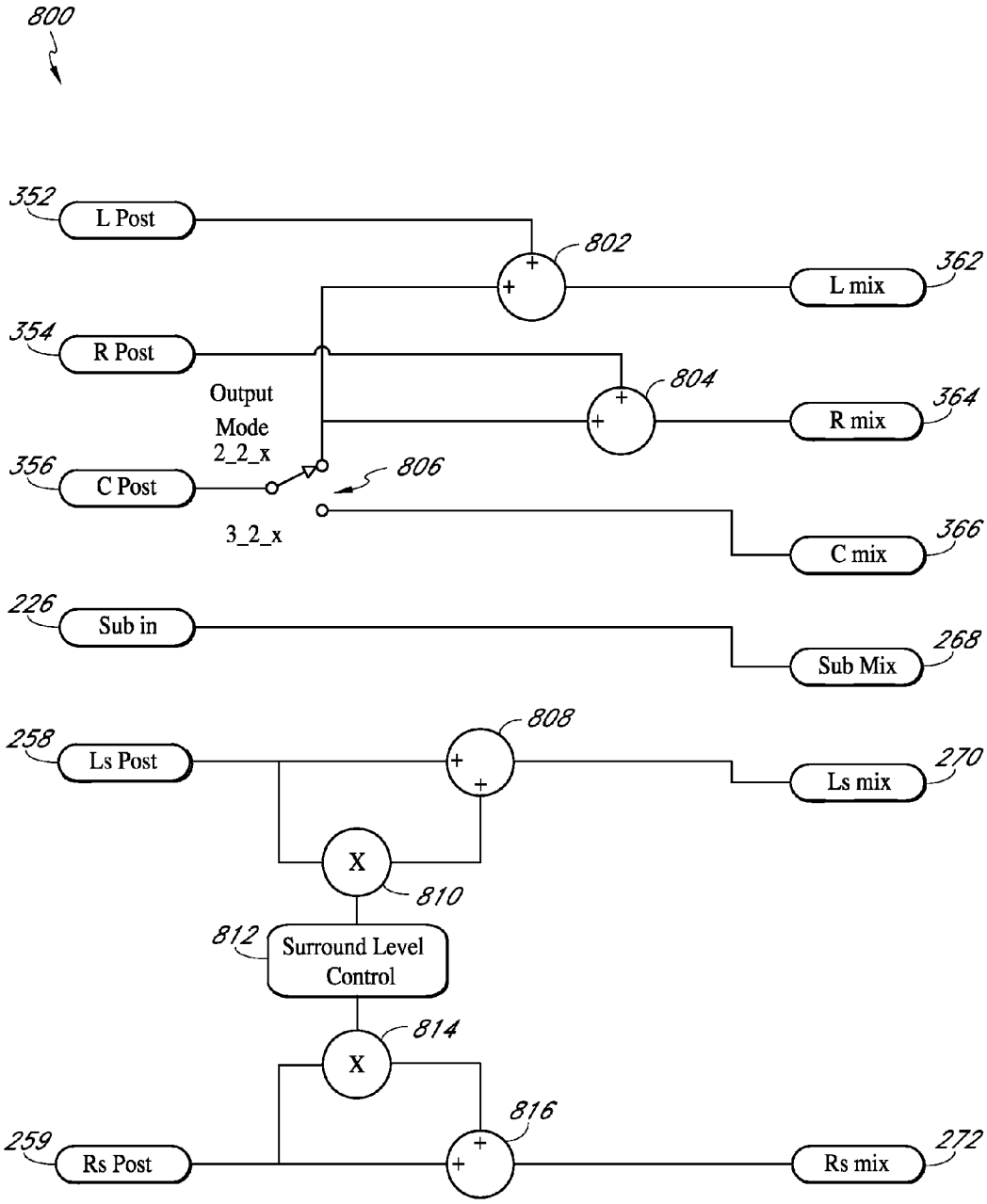
FIG. 8 illustrates an embodiment of an output mix module of the audio systems of FIGS. 2 and 3.

FIG. 8 illustrates an embodiment of an output mix module 800. In certain embodiments the output mix module 800 is a more detailed example implementation of the output mix module 260. In certain embodiments, the output mix module 800 includes components for mixing one or more of the post outputs 252, 254, and 256 of the audio system 200, or the post outputs 352, 354, and 356 of the audio system 300. The output mix module 800 in certain embodiments also passes the left and right surround post outputs 258, 259 and the subwoofer input 226 without mixing these signals.

The output mix module 260 receives, for example, the left post output 352, the right post output 354, the center post output 356, the subwoofer input 226, the left surround post output 258, and the right surround post output 259. The left post output 352 is provided to a sum block 802. The sum block also receives the output of switch 806. Switch 806 receives the center post output 356. The center post output 356 is passed by the switch 806 to sum block 802 if the output mode is either 2_2_x or 3_2_x. Otherwise, the center post output 356 is provided by the switch 806 directly as the center mix output 366. The output of the sum block 802 is the left mix output 362.

The right post output 354 is provided to a sum block 804. Sum block 804 likewise receives the output of the switch 806 if the output mode is either 2_2_x or 3_2_x. The output of sum block 804 is provided as the right mix output 364. The subwoofer input 226 is provided directly as the subwoofer mix output 268.

The left surround post output 258 is provided to a multiply block 810 and a sum block 808. The multiply block 810 multiplies the left surround post output 258 with a surround level control input 812. The surround level control input 812 in certain embodiments adjusts the level of rear surround effect provided by an audio system, such as the audio system 200 or 300. The output of the multiply block 810 is provided to the sum block 808, which adds this output with the left surround post output 258. The output of the sum block 808 is provided as the left surround mix output 270.

In a similar manner, the right surround post output 259 is provided to a sum block 816 and to a multiply block 814. The multiply block 814 multiplies this output 259 with the surround level control input 812. The output of the multiply block 814 is provided to the sum block 816 to be summed with the right surround post output 259. The sum block 816 provides an output as the right surround mix output 272.

Figure 9A:
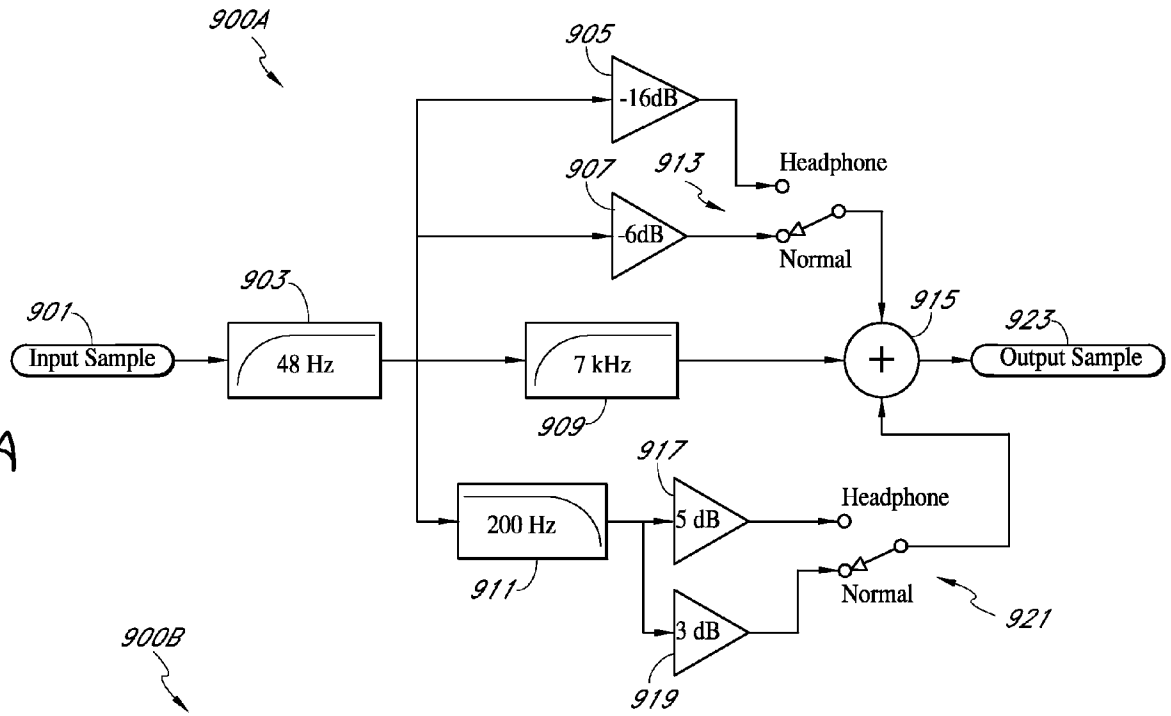
FIGS. 9A and 9B illustrate embodiments of perspective filters of the surround processing modules of FIGS. 6 and 7, respectively.

FIG. 9A illustrates an embodiment of front perspective module 900A, which in certain embodiments represents a more detailed implementation of the perspective front space module 618. The front perspective module 900A beneficially includes one or more perspective filters or curves for producing or enhancing a front surround sound effect.

The front perspective module 900A is shown receiving an input sample 901. The input sample 901 is provided to a filter 903. In the depicted embodiment, the filter 903 is a high pass filter having a corner frequency of about 48 hertz (Hz). Other values, however, may be chosen in other embodiments.

The output of the filter 903 is provided to a gain block 905, a gain block 907, a filter 909, and a filter 911. The gain block 905 in the depicted embodiment includes an example −16 dB gain (e.g., attenuation). The output of the gain block 905 is provided to a switch 913. The gain block 907 includes an example −6 dB gain. The output of the gain block 907 is also provided to the switch 814. If the output mode is set to headphone, then the switch 913 passes the output from the gain block 905 to a sum block 915. Conversely, if headphones are not used as an output mode, the switch 913 passes the output of gain block 907 to the sum block 915.

The filter 909 in the depicted embodiment is a high pass filter having a corner frequency of about 7 kilohertz (kHz). The value of the corner frequency may be varied in certain embodiments. The output of the pass filter 909 is provided to the sum block 915. The filter 911 in the depicted embodiment is a low pass filter having a corner frequency of about 200 Hz. The output of the filter 911 is provided to gain blocks 917 and 919. The value of the gain block 917 in certain embodiments is 5 dB, although this value may be varied. The value of the gain block 917 is provided to switch 921.

The gain block 919 has a value of 3 dB in certain embodiments, although this value may also be varied. The output of the gain block 919 is passed to the switch 921. If the output mode is set to headphone, then the switch 921 passes the output from the gain block 917. Otherwise, the switch 921 passes the output from the gain block 919. The output from the switch 921 is provided to the sum block 915, which sums the outputs from the switch 913, the filter 909, and the switch 921 to provide an output sample 923.

In certain embodiments, while the filters 903, 909, and 911 are shown separately, their processed output by the sum block 915 comprises a perspective filter curve. This perspective filter or curve can have a different shape or frequency response in head phone mode than in other ("Normal") modes. Thus, the terms perspective filter or curve in certain embodiments can refer to both the combination of the filters 903, 909, 911 and to each filter 903, 909, 911 separately. Example frequency response curves of the combined filters 903, 909, and 911 are described with respect to FIG. 14 below.

Figure 9B:
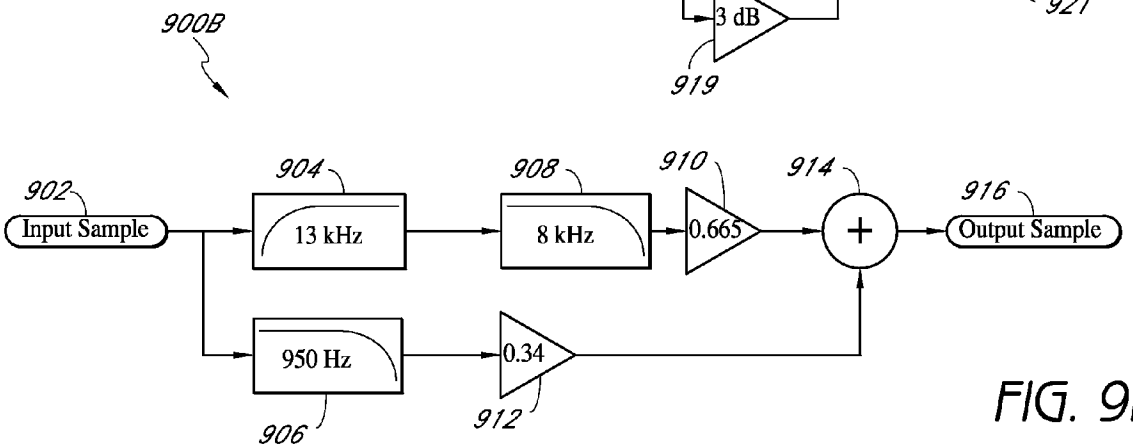

FIG. 9B illustrates an embodiment of rear perspective module 900B, which in certain embodiments represents a more detailed implementation of one or both of the perspective rear space and center modules 708, 716. The rear perspective module 900B beneficially includes one or more perspective filters or curves for producing or enhancing a front surround sound effect.

In certain embodiments, the rear perspective filter module 900B receives an input sample 902, which is passed to a filter 904 and a filter 906. The filter 904, in certain embodiments, is a high pass filter, with a corner frequency of about 13 kHz. This value may be varied in certain embodiments.

The output of the filter 904 is passed to a filter 908, which is a low pass filter having a corner frequency of 8 kHz in certain embodiments. The output of the filter 908 is passed to a gain block 910, which has a value of 0.665 (no units). This value may also be varied in certain embodiments. The output of the gain block 910 is provided to sum block 914.

The filter 906, in certain embodiments, is a low pass filter having an example corner frequency of 950 Hz. The output of the filter 906 is provided to a gain block 912, which includes an example value of 0.34 (no units). The output of the gain block 912 is provided to the sum block 914, which sums the output of the gain block 912 and the output of the gain block 910 to produce an output sample 916.

In certain embodiments, while the filters 904, 906, 908 are shown separately, their processed output by the sum block 914 comprises a perspective filter curve. Thus, the terms perspective filter or curve in certain embodiments can refer to both the combination of the filters 904, 906, 908 and to each filter 904, 906, 908 separately.

Figure 10:
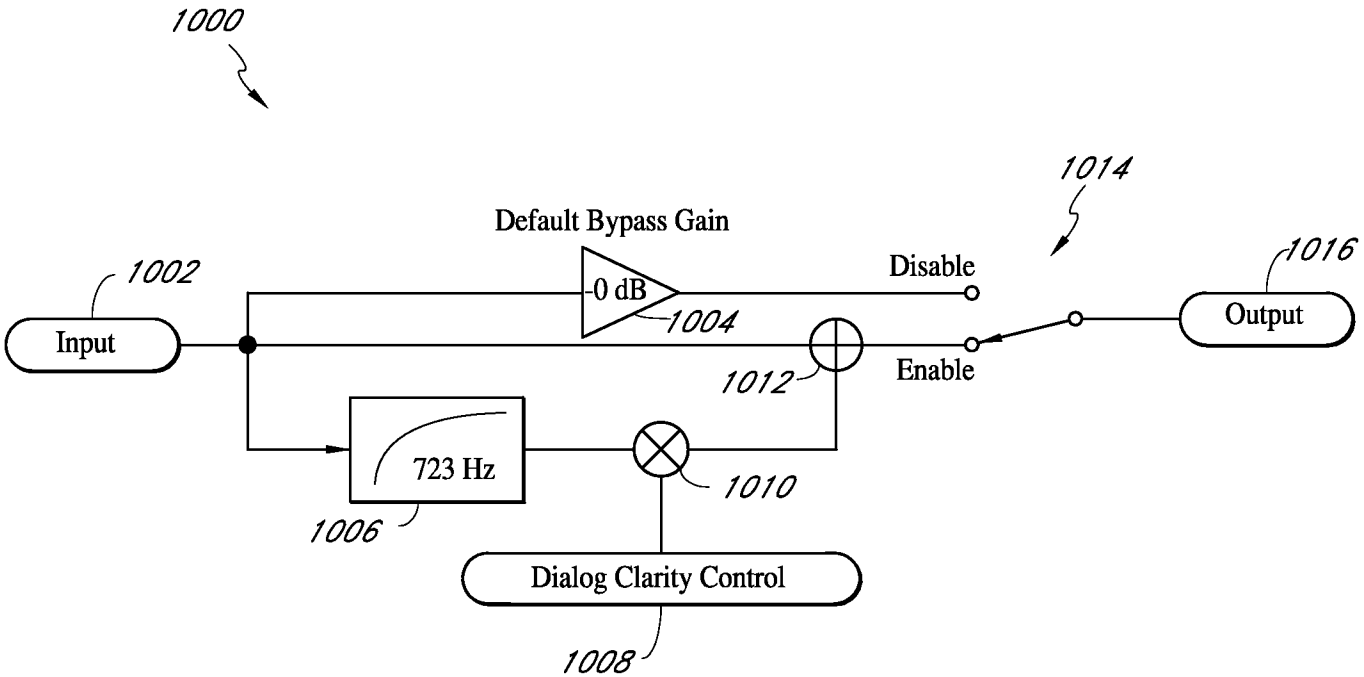
FIG. 10 illustrates an embodiment of a dialog clarity module of the audio system of FIG. 3.

FIG. 10 illustrates an embodiment of a dialog clarity module 1000, which in certain embodiments represents a more detailed implementation of the dialog clarity modules 351, 651 described above.

The dialog clarity module 1000 in certain embodiments receives an input sample 1002. The input sample 1002 is provided to a gain block 1004 and to a filter 1006. The value of the gain block 1004 is 0 dB. In an embodiment the gain block 1004 comprises a default bypass gain. The output of the gain block 1004 is provided to switch 1014. If dialog clarity is enabled, then the switch 1014 does not pass the output of the gain block 1004. However, if dialog clarity is disabled, then the output of the gain block 1004, which in certain embodiments is the same or substantially the same as the input sample 1002, is passed by the switch 1014 to the output 1016. Dialog clarity can be enabled or disabled, for example, by a listener.

The filter 1006 is a high pass filter in certain embodiments, having a corner frequency of about 723 hertz, although this value may be varied. In certain embodiments, a transfer function H(z) describing the filter 1006 is given by:

$$H(z) = \frac{b_0 + b_1 z^{-1}}{1 - az^{-1}},$$

where a, $b_0$, and $b_1$ represent filter coefficients, and where z represents an independent complex variable. In certain embodiments, a Transposed Direct Form II implementation of this transfer function can be provided as follows, with $b=b_0=-b_1$:

$$y[n]=y[n-1]+bx[n]$$

$$y[n-1]=-bx[n]+ay[n],$$

where n represents an independent variable, x[n] represents an input signal as a function of n, and y[n] represents an output signal as a function of n. Example frequency response curves associated with the filter 1006 are described below with respect to FIG. 15.

The output of the high pass filter is provided to a multiply block 1010 which receives a dialog clarity control input 1008. In certain embodiments, the dialog clarity control input 1008 has a value from 0 to 1. The dialog clarity control input 1008 can determine the amount of dialog clarity enhancement that is applied to the input signal 1002. In one example embodiment, the dialog clarity enhancement has a value of 0.5. However, other ranges and values also may be used.

The multiply block 1010 multiplies the dialog clarity control input 1008 with the output of the filter 1006 to produce an output which is provided to sum block 1012. Sum block 1012 sums the input sample 1002 with the output of the multiply block 1010 and provides an output to the switch 1014. If the switch 1014 is enabled, then the switch 1014 passes the output from the sum block 1012 as the output sample 1016.

Figure 11:
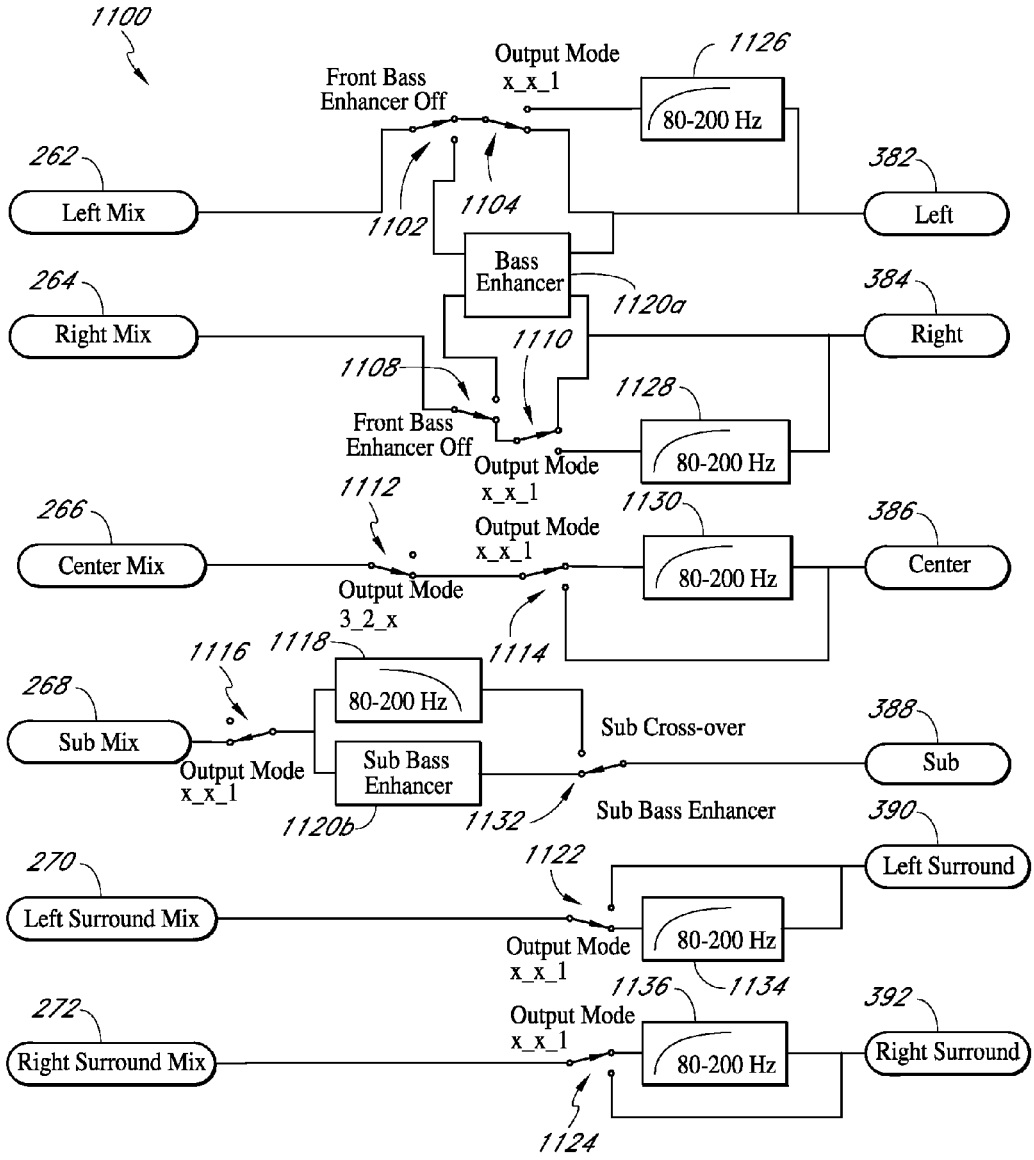
FIG. 11 illustrates an embodiment of a bass management module of the audio system of FIG. 3.

FIG. 11 illustrates an example embodiment of a bass management network 1100. In certain embodiments, the bass management network 1100 represents a more detailed embodiment of the bass management network 380 described above. Advantageously, the bass management network 1100 can enhance bass responses on subwoofer and non-subwoofer audio channels.

The bass management network 1000 in certain embodiments includes bass enhancers 1120*a* and 1120*b*. Advantageously, the bass enhancers 1120 can enhance audio frequencies associated with a bass output. In addition, the bass management network 380 includes an optional crossover network, which includes one or more of filters 1126, 1128, 1130, 1118, 1122, and 1136. In certain embodiments, this crossover network enables bass frequencies to be localized in the subwoofer output 388 in some implementations where the subwoofer output 388 is used. Certain embodiments of frequency responses for the filters 1126, 1128, 1130, 1118, 1122, and 1136 are described below with respect to FIG. 17.

The bass management system 1000 receives a left mix output 262, a right mix output 264, a center mix output 266, a subwoofer mix output 268, a left surround mix output 270, and a right surround mix output 272 from the output mix module 260. The left mix output 262 is provided to switch 1102. If a bass enhancer 1120*a* is to be turned off, for example, by a listener, the switch 1102 passes the left mix output 262 to switch 1104. If a subwoofer is not provided on the output (e.g., output mode is x_x__0), then the switch 1104 passes the left mix output 262 as the left output 382.

If, however, the bass enhancer is to be turned on, for example, by a listener, then the switch 1102 passes the left mix output 262 to the bass enhancer 1120*a*. The bass enhancer 1120*a* processes the left mix output 262 to enhance the bass response of selected low frequencies and passes an output as the left output 382 and an output as the right output 384. Further details of an example bass enhancer 1120*a* are described below with respect to FIG. 12. In addition, the bass enhancer 1120*a* (and the bass enhancer 1120*b*) can, in certain embodiments, use some or all of the bass enhancement techniques disclosed in U.S. Pat. No. 6,285,767 to Klayman, titled "Low-Frequency Audio Enhancement System," issued Sep. 4, 2001, the disclosure of which is hereby incorporated by reference in its entirety.

If the output mode is x_x__1, then the switch 1104 passes the left mix output 262 to the filter 1126. As described above, the filter 1126 is part of the crossover network and is used in certain embodiments when the subwoofer output 388 is present (e.g., during x_x__1 output modes). However, the crossover network filters, including the filter 1126, need not be used in every case where the subwoofer output 388 is used.

The filter 1126 is a high pass filter in the depicted embodiment, having a configurable corner frequency from a range of about 80 to about 200 hertz. The corner frequency, in one embodiment, can be selected by a listener. In another embodiment, the corner frequency is hard-coded into the bass management module 380. Other ranges or values for the corner frequency can be chosen in certain embodiments. Advantageously, by providing a high pass filter with a corner frequency of about 80 to about 200 hertz, the filter 1126 removes the low frequency components in the left mix output 262 and thereby facilitates localizing the low frequency components on the subwoofer output 388. The output of the filter 1126 is provided as the left output 382.

The right mix output 264 is provided to a switch 1108. If the bass enhancer 1120*a* is to be turned off, for example by a listener, the switch 1108 passes the right mix output 264 to the switch 1110. If the output mode is x_x__1, the switch 1110 passes the right mix output 264 as the right output 384. If, however, the bass enhancer is to be turned on, then the switch 1108 passes the right mix output 264 to the bass enhancer 1120*a*, which in turn passes an output as the right output 384 and an output as the left output 382.

If the output mode is x_x__0, the switch 1110 passes the right mix output 264 to the filter 1128. In certain embodiments, the filter 1128 incorporates some or all of the same functionality as the filter 1126. The filter 1128 provides the right output 384.

The center mix output 266 is passed to a switch 1112. If the output mode is 3__2_x, the switch 1112 passes the center mix output 266 to switch 1114. Otherwise, the switch 1112 does not pass the center mix output 266. The switch 1114 passes the center mix output 266 as the center output 386 if the output mode is x_x__1. However, if the output mode is x_x__0, the switch 1114 passes the center mix output 266 to the filter 1130. In certain embodiments, the filter 1130 has the same or some of the same functionality as filters 1126. The output of the filter 1130 is provided as the center output 386.

The subwoofer mix output 268 is passed to the switch 1116. If the output mode is x_x__1, then the switch 1116 passes the subwoofer mix output 268 to the filter 1118 and to a subwoofer bass enhancer 1120*b*. Otherwise, the switch 1116 does not pass the subwoofer mix output 268. The filter 1118, in certain embodiments, is a low pass filter having a corner frequency of about 80 to 200 hertz. In one embodiment, the corner frequency of the filter 1118 is set to be equal to the corner frequencies of filters 1126, 1128, and 1130. Advantageously, by establishing this arrangement with the same corner frequencies, the filters 1118, 1126, 1128, 1130 and as described below 1134 and 1136 facilitate localizing the bass or low frequency components of an audio signal on the subwoofer.

The signal from the switch 1116 is also passed to the subwoofer bass enhancer 1120*b*, which enhances the low frequency components of the bass signal. The output of the filter 1118 is provided to switch 1132 and the output of the subwoofer bass enhancer 1120*b* is provided to switch 1132. If the sub bass enhancer is selected to be turned on, for example by a listener, then the switch 1132 passes the output of the sub bass enhancer 1120*b* but not the output of the filter 1118. Otherwise, if the sub crossover network is selected to be turned on, for example by a user, then the output of the filter 1118 is passed by the switch 1132 and the switch 1132 does not pass the output of the subwoofer bass enhancer 1120*b*. The output of the switch 1132 is passed as the subwoofer output 388.

The left surround mix output 270 is passed to a switch 1122. If the output mode is x_x__1, then the switch passes the left surround mix output 270 to the filter 1134, which in certain embodiments includes some or all of the functionality of the filter 1126. The output of the filter 1134 is provided as the left surround input 391. Alternatively, if the output mode is x_x__0, the switch 1122 provides the left surround mix output 270 directly as the left surround output 391.

The right surround mix output 272 is provided to a switch 1124. If the output mode is x_x__1, the switch 1124 passes the right surround mix output 272 to a filter 1136, which in certain embodiments includes some or all of the functionality of the filter 1126. The filter 1136 provides an output which is the right surround output 392. Otherwise, if output mode x_x__0 is selected, the switch 1124 passes the right surround mix 272 directly as right surround output 392.

Figure 12:
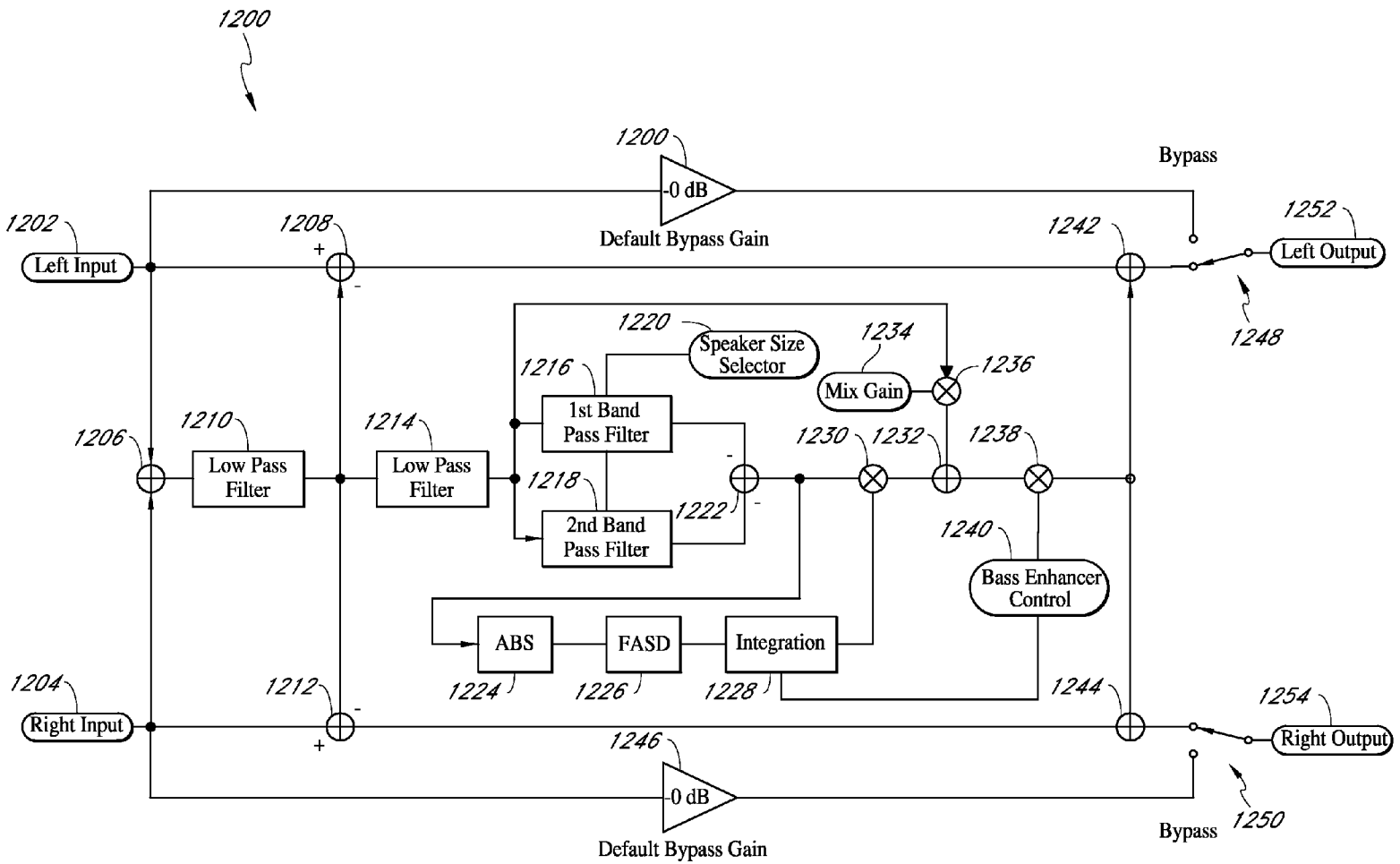
FIG. 12 illustrates an embodiment of a bass enhancer of the bass management module of FIG. 11.

FIG. 12 illustrates an example bass enhancer 1200. The bass enhancer 1200 in certain embodiments can be a more detailed implementation of the bass enhancer 1120*a* and/or 1200*b* described above. The bass enhancer 1200 can enhance audio frequencies associated with a bass output. Example frequency responses generated by the bass enhancer 1200 are described below with respect to FIG. 16.

The bass enhancer 1200 is shown in the depicted embodiment receiving a left input 1202 (e.g., a sample) and a right input 1204 (e.g., a sample). Both the left and the right inputs 1202 and 1204 are provided to default bypass gain blocks 1201 and 1246, respectively. The default bypass gain blocks 1201 and 1246 each have 0 dB gain such that if the bass enhancer 1200 is bypassed, then the left input 1202 and the right input 1204 are passed directly to the left output 1252 and the right output 1254, respectively. A switch 1248 and a switch 1250 respectively determine whether the bass enhancer 1200 is to be bypassed.

The left input 1202 is also passed to a sum block 1208 and to a sum block 1206. Likewise, the right input 1204 is passed to a sum block 1202 and to the sum block 1206. The output of the sum block 206 is a combined output of the sum of the left inputs 1202 and the right input 1204. The output of the sum block 1206 is provided to a low pass filter 1210.

The output of the low pass filter is provided to the sum block 1208 and to another low pass filter 1214. In addition, the output of the low pass filter 1210 is provided to a sum block 1212. The sum block 1208 subtracts the input received from the low pass filter 1210 from the left input 1202 and provides an output to a sum block 1242. The sum block 1212 subtracts the low pass filter 1210 output from the right input 1204 and provides an output to the sum block 1244.

The low pass filter 1214 provides outputs to a multiply block 1236, to a first band pass filter 1216, and to a second band pass filter 1218. In certain embodiments, the cutoff frequencies of the low-pass filters 1210 and the band-pass filters' 1216, 1218 center frequencies can be adjusted to match the frequency response of speakers being used with an audio system. A speaker size selector input 1220 is provided to the first band pass filter 1216 and the second band pass filter 1218. In an embodiment speaker size selector input 1220 can be selected so that the lowest of the band-pass center frequencies is just above the low cutoff frequency of the speaker system. An example table of center and corner frequencies of the filters 1216, 1218, 1210 according to the speaker size selector input 1220 is provided in the following Table 3:

TABLE 3

Example Speaker Size Selector Guidelines

| Speaker Cutoff Frequency | Band Pass Filter Center Frequencies | | Low Pass Filter |
|---|---|---|---|
| 40 Hz | 40 Hz | 70 Hz | 40 Hz |
| 60 Hz | 61 Hz | 105 Hz | 60 Hz |
| 100 Hz | 101 Hz | 175 Hz | 100 Hz |
| 150 Hz | 151 Hz | 263 Hz | 150 Hz |
| 200 Hz | 202 Hz | 351 Hz | 200 Hz |
| 250 Hz | 252 Hz | 439 Hz | 250 Hz |
| 300 Hz | 315 Hz | 462 Hz | 300 Hz |
| 400 Hz | 420 Hz | 568 Hz | 400 Hz |

The outputs of the band pass filters 1216 and 1218 are provided to a sum block 1222. In certain embodiments, the sum block 1222 adds the additive inverse of the output of each band pass filter 1216, 1218 such that the output of each band pass filter 1216, 1218 is inverted and then added by the sum block 1222. The output of the sum block 1222 is provided to a multiply block 1230 and to an absolute value block 1224.

The absolute value block 1224 takes the absolute value of the input and provides a rectified output to a fast attack slow decay (FASD) module 1226. The FASD module 1226 in certain embodiments detects peaks in the output of the absolute value block 1224. The FASD module 1226 can be used, for example, to control attack and release times of the bass enhancer 1200.

The output of the FASD module 1226 is provided to an integration module 1228, which provides an integrated output to the multiply block 1230 and to a bass enhancer control 1240. The multiply block 1230 provides an output to sum block 1232. Likewise, the multiply block 1236 supplies an output to the sum block 1232. The multiply block 1236 receives a mix gain input 1234, which in certain embodiments provides a flatter frequency response of the bass enhancer 1200 when the bass enhancer control 1240 is turned to a minimum setting.

The output of the sum block 1232 is provided to multiply block 1238 which also receives the bass enhancer control input 1240. In certain embodiments, the bass enhancer control input 1240 specifies the amount of bass enhancement provided to the input signals 1202, 1204. In certain embodiments, the bass enhancer control input 1240 ranges from 0 to 1. However, other ranges may be used.

The output of the multiply block 1238 is provided to both the sum blocks 1242 and 1244. The output of the sum block 1244 is provided to the switch 1248, which is passed to the left output 1252 if bypass is not enabled. The output of the sum block 1244 is provided to the switch 1250, which passes the output of the sum block 1244 as right output 1254 if the bypass is not enabled.

Figure 13:
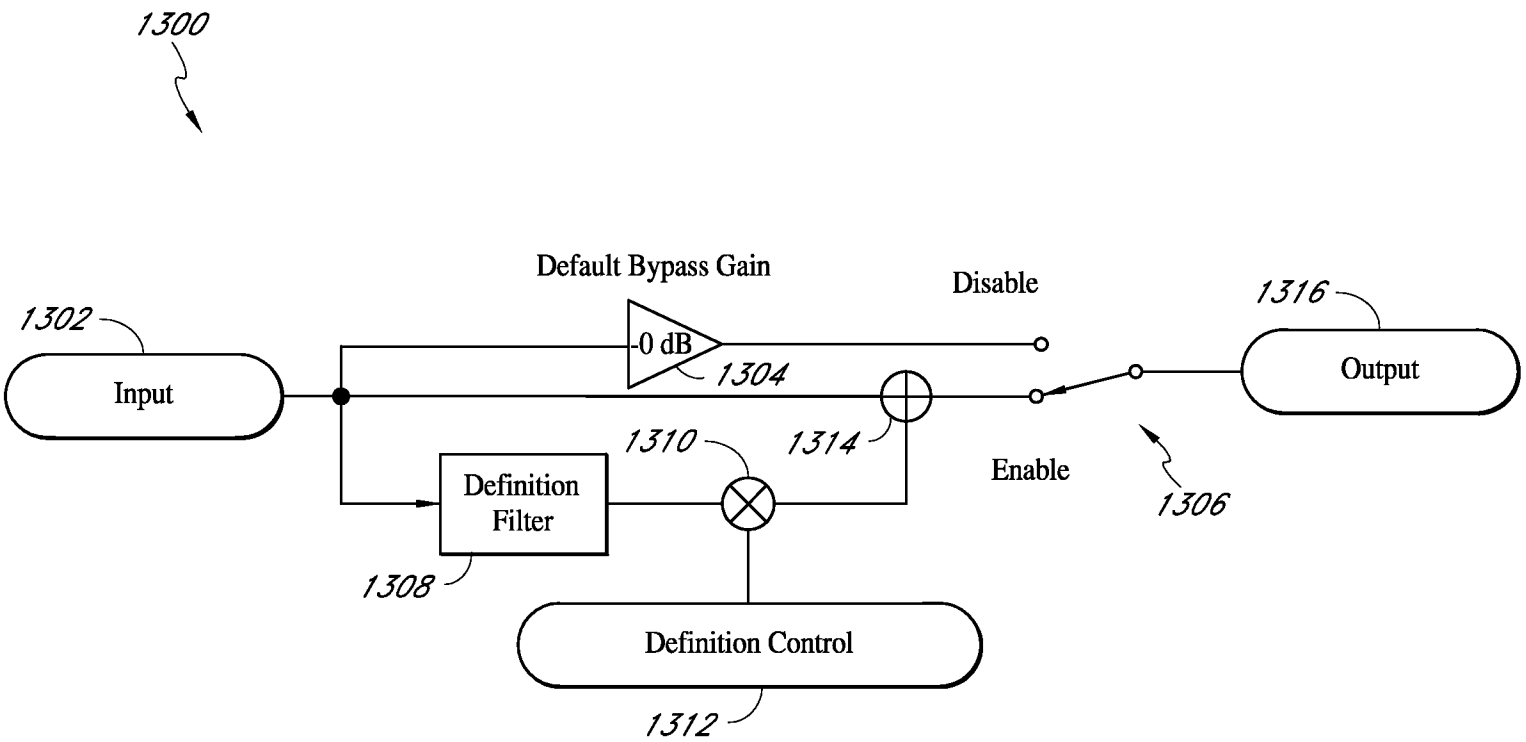
FIG. 13 illustrates an embodiment of a definition module of the audio system of FIG. 3.

Turning to FIG. 13, an embodiment of a definition module 1300 is shown. In certain embodiments, the definition module 1300 represents a more detailed implementation of one or more of the definition modules 393 described above. In some implementations, perceptual coding techniques used in digital compression, and audio processing technology used in broadcast transmission paths, can reduce the clarity of reproduced audio. The definition module 1300 therefore can improve the perception of clarity and acoustic space in certain embodiments.

The definition module 1300 receives an input sample 1302 which is provided to a default bypass gain block 1304 and to a definition filter 1308. In addition, the input sample 1302 is provided to a sum block 1314. In an embodiment, the default bypass gain block 1304 has a 0 dB gain and therefore does not amplify or does not substantially amplify or attenuate the input sample 1302.

The output of the default bypass gain block 1304 is provided to a switch 1306. If definition control is enabled, for example, by a user, the switch 1306 does not pass the output of the default bypass gain 1304. However, if definition control is disabled, the switch 1306 passes the output of the default bypass gain block 1304 as the output sample 1316.

The definition filter 1308 in certain embodiments processes the input sample 1302 to emphasize certain high frequency regions of the input sample 1302. An example frequency response of the definition filter 1308 is described below with respect to FIGS. 18 and 19.

The definition filter 1308 outputs the process sample to multiplier block 1310 which also receives the definition control signal 1312. The definition control signal 1312 can determine the amount of definition control provided to the input sample 1302. In certain embodiments, the range of values the definition control signal 1312 has is from 0 to 1. However, other ranges may be used.

The multiplier block 1310 provides an output to a sum block 1314 which provides an output to the switch 1306. If definition control is enabled, then the switch 1306 passes the output of the sum block 1314 as the output 1316.

FIGS. 14 through 19 illustrate graphs of example embodiments of some or all of the filters described above. The graphs are plotted on a logarithmic frequency scale and an amplitude scale which is measures in dBFS, or decibels full scale. While phase graphs are not shown, in certain embodiments each respective graph has a corresponding phase graph. In addition, different graphs may have different magnitude scales reflecting that different filters may have different amplitudes, so as to emphasize certain components of sound and de-emphasize others.

Figure 14:
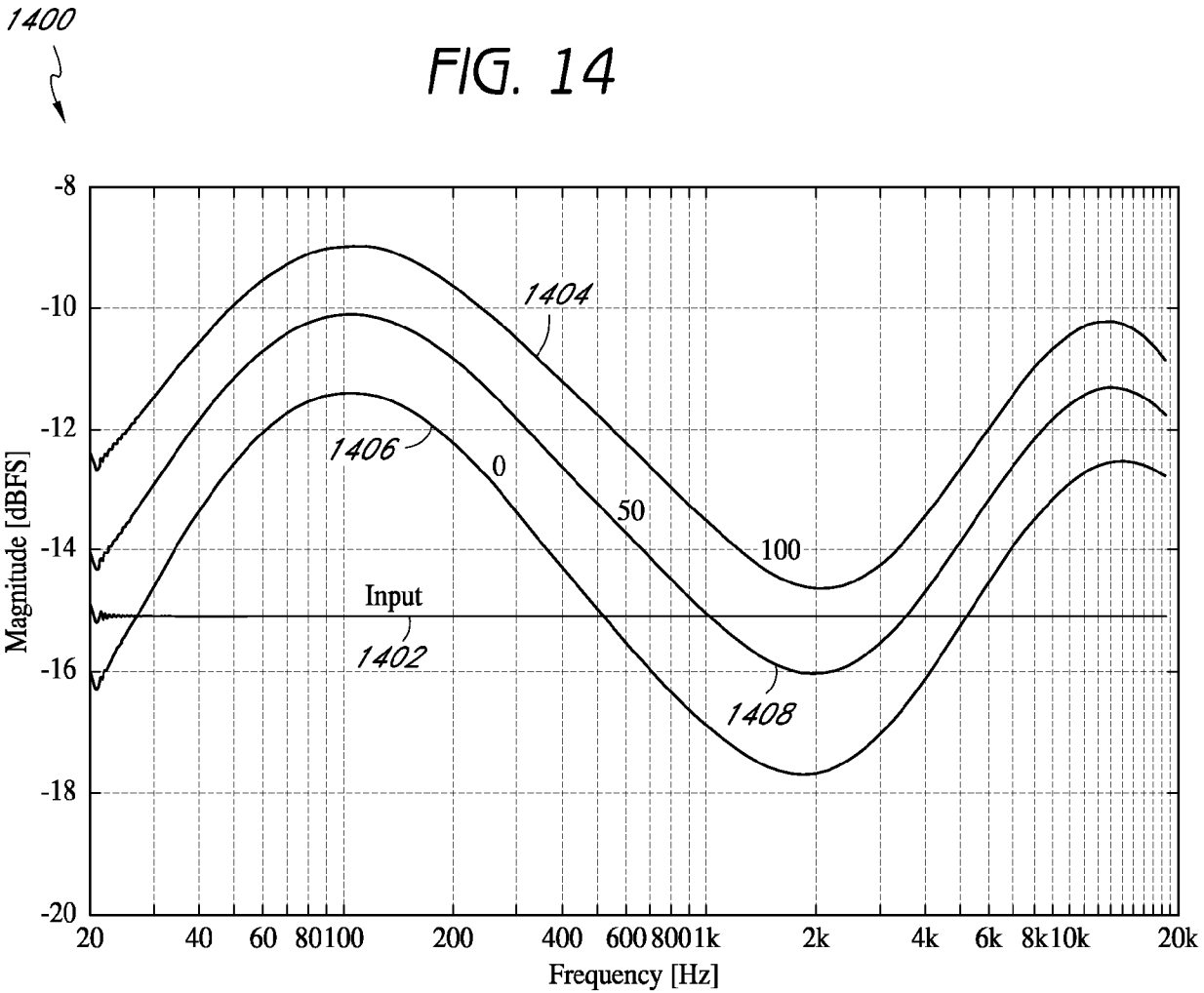
FIGS. 14-19 illustrate embodiments of frequency response curves corresponding to filters used in the audio systems of FIGS. 2 and/or 3.
Figure 15:
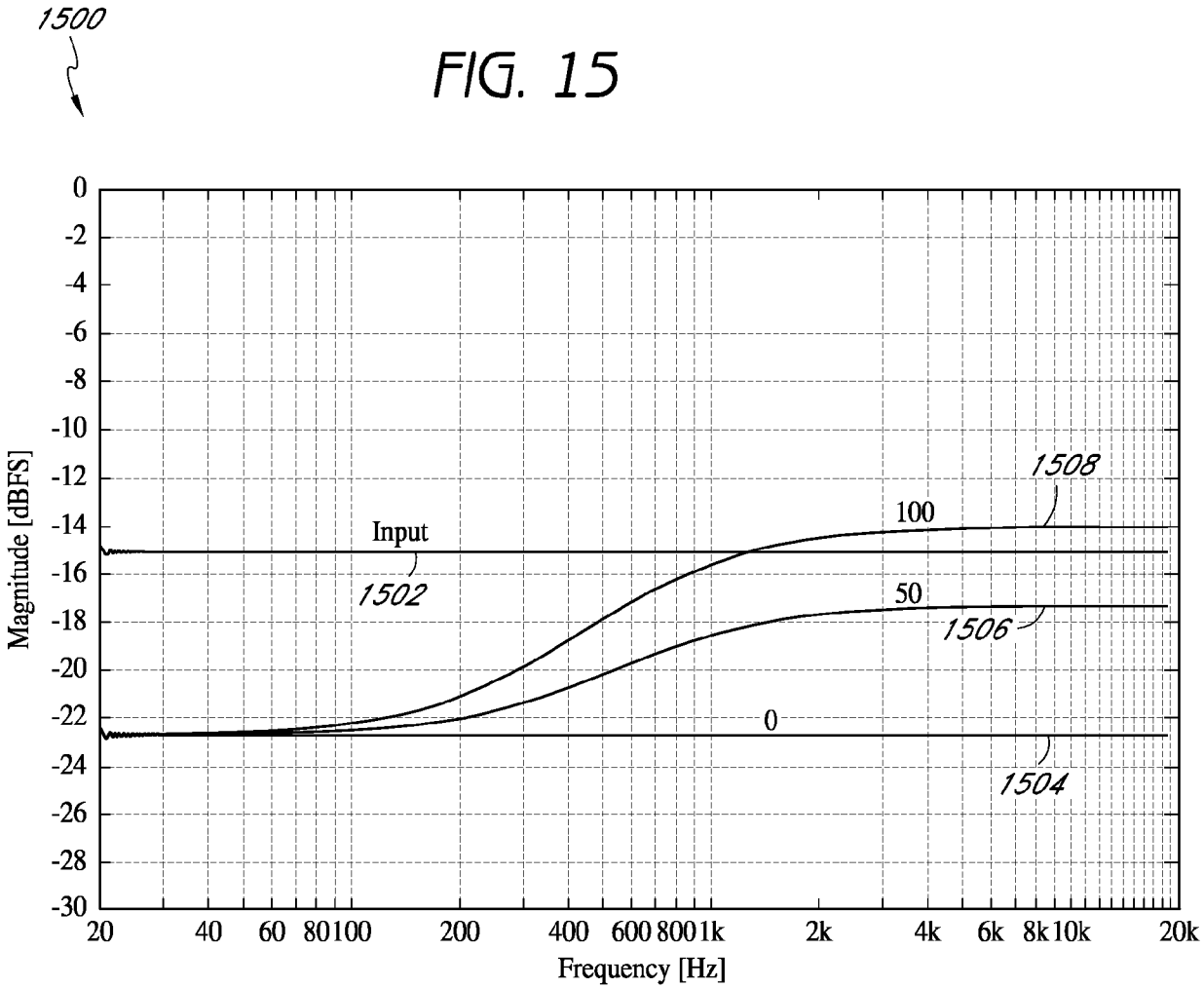

In the depicted embodiments, each graph is shown having an input. For example, FIG. 14 depicts an input 1402, FIG. 15 depicts an input 1502, and so on. The input in certain embodiments is a −15 dBFSs input that is swept across the entire, or substantially entire, audible frequency range, from 20 Hz to 20 kHz. Each graph also includes one or more traces. For example, FIG. 14 includes traces 1404, 1406, and 1408. The traces show an example magnitude response of the filter over the displayed frequency range.

While the responses show by the traces in FIGS. 14 through 19 are shown throughout the entire 20 Hz to 20 kHz frequency range, these response in certain embodiments need not be provided through the entire audible range. For example, in certain embodiments, certain of the frequency responses can be truncated to, for instance, a 40 Hz to 10 kHz range with little or no loss of functionality. Other ranges may also be provided for the frequency responses.

Turning to FIG. 14, a graph 1400 is shown which illustrates traces 1404, 1406 and 1408. In certain embodiments, the traces 1404, 1406 and 1408 illustrate example frequency responses of one or more of the perspective filters described above, such as the front and or rear perspective filters. The trace 1404 represents an example embodiment where a surround level setting is set to 0%. Trace 1406 is an example embodiment where a surround level setting is set to 50%, and trace 1408 is an example trace where the surround level is set to 100%.

The trace 1404 starts at about −16 dBFS at about 20 Hz, and increases to about −11 dBFS at about 100 Hz. Thereafter, the trace 1404 decreases to about −17.5 dBFS at about 2 kHz and thereafter increases to about −12.5 dBFS at about 15 kHz. The trace 1406 starts at about −14 dBFS at about 20 Hz, and it increases to about −10 dBFS at about 100 Hz, and decreases to about −16 dBFS at about 2 kHz, and increases to about −11 dBFS at about 15 kHz. The trace 1408 starts at about −12.5 dBFS at about 20 Hz, and increases to about −9 dBFS at about 100 Hz, and decreases to about −14.5 dBFS at about 2 kHz, and increases to about −10.2 dBFS at about 15 kHz.

As shown in the depicted embodiments of traces 1404, 1406, and 1408, frequencies in about the 2 kHz range are de-emphasized by the perspective filter, and frequencies at about 100 Hz and about 15 kHz are emphasized by the perspective filters. These frequencies may be varied in certain embodiments.

FIG. 15 illustrates an example graph of a frequency response or responses of an example dialog clarity filter. The frequency responses include two example responses illustrated by traces 1506 and 1508. In certain embodiments, the frequency responses illustrated by traces 1506 and 1508 comprise high pass filters because the frequency responses emphasize higher frequencies and de-emphasize lower frequencies. The trace 1504 represents a 0% level of dialog clarity. The trace 1506 represents a 50% level of dialog clarity. The trace 1508 represents a 100% level of dialog clarity.

In an embodiment, the trace 1504 is about −22.5 dBFS for the entire audible frequency spectrum. In one embodiment, the trace 1506 starts at about −22.5 dBFS at about 20 Hz and increases to about −17 dBFS at about 2 kHz. The trace 1508 starts at about −22.5 dBFS at about 20 Hz and increases to about −14 dBFS at about 2 kHz.

Figure 16:
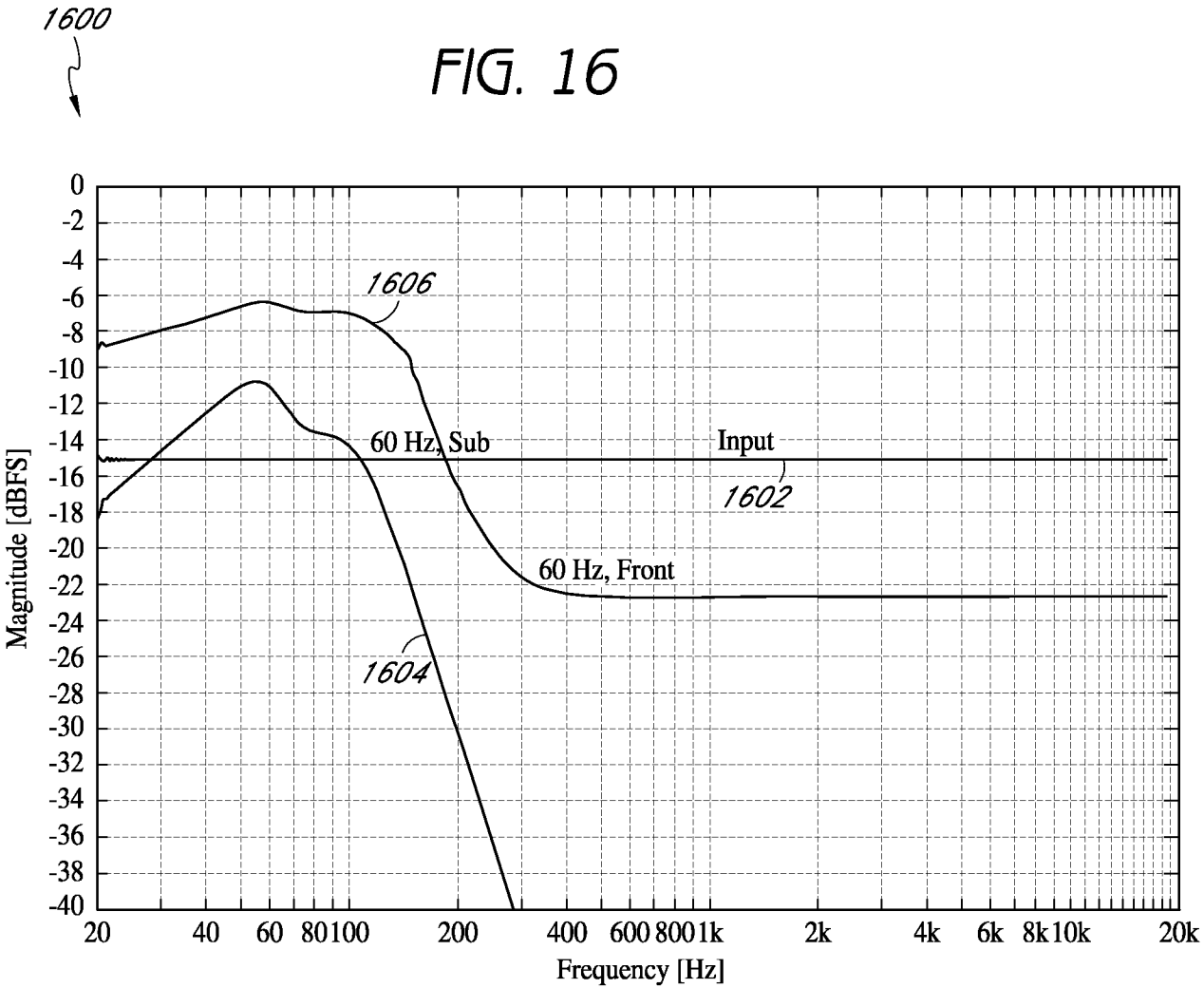

FIG. 16 illustrates an example graph 1600 showing embodiments of traces 1604 and 1606. The traces 1604 and 1606 illustrate example frequency responses of front and subwoofer bass enhancers, which in an embodiment, are the same bass enhancer implemented with different frequency responses of the respective filters.

The trace 1604 starts at about −18 dBFS at about 20 Hz and increases to about −11 dBFS at about 55 Hz, and thereafter decreases to less than −40 dBFS at about 300 Hz. The trace 1606 starts at about −9 dBFS at about 20 Hz and increases to about −6.2 dBFS at about 60 Hz, and decreases to about −23 dBFS at about 400 Hz. The curves shown by traces 1604 and 1606 illustrate traces or frequency responses of a bass enhancer for a speaker with a 60 Hz cutoff frequency. Different frequency responses may be provided for other speakers having different cutoff frequencies.

Figure 17:
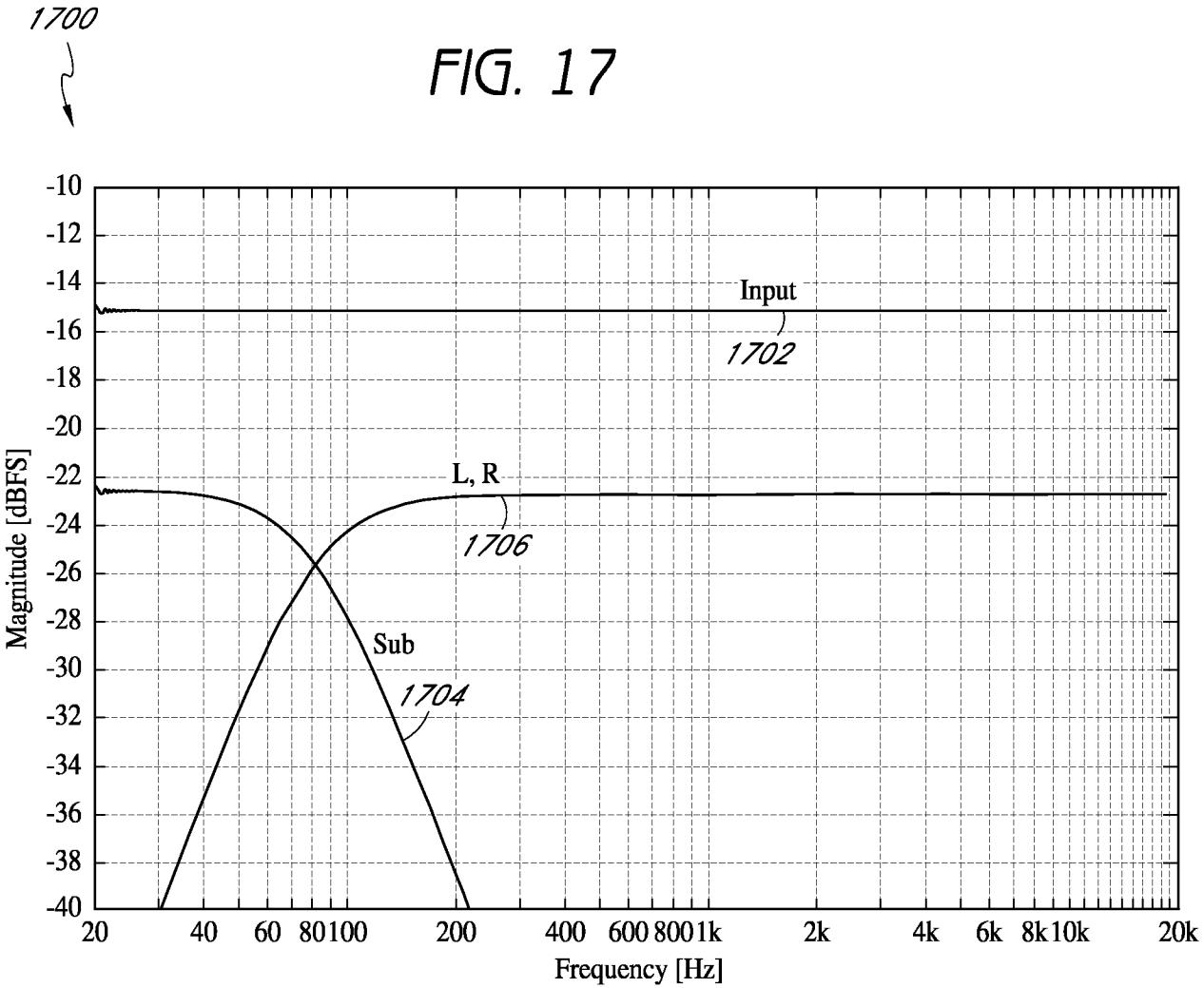

FIG. 17 illustrates an example graph 1700 which depicts an embodiment of filters used in a crossover network, such as the crossover networks described above. The frequency responses of two example filters are shown, including a frequency response represented by trace 1704 and a frequency response represented by trace 1706. In one embodiment, the frequency response represented by trace 1704 corresponds to a crossover network filter applied to a subwoofer, and the trace 1706 represents a frequency response of a crossover network filter applied to front left and/or right speakers.

The trace 1704 starts at about −22.5 dBFS at about 20 Hz and falls off to about −40 dBFS at about 220 Hz. The corner frequency for the trace 1704 is about 60 Hz. The trace 1706 starts at about −40 dBFS at about 30 Hz and increases to about −23 dBFS at about 200 Hz. Advantageously, the trace 1704 and the trace 1706 illustrates that the crossover network filters out low frequencies on the non-subwoofer channels and filters out high frequencies on the subwoofer channel, thereby localizing a bass response on the subwoofer channel.

Figure 18:
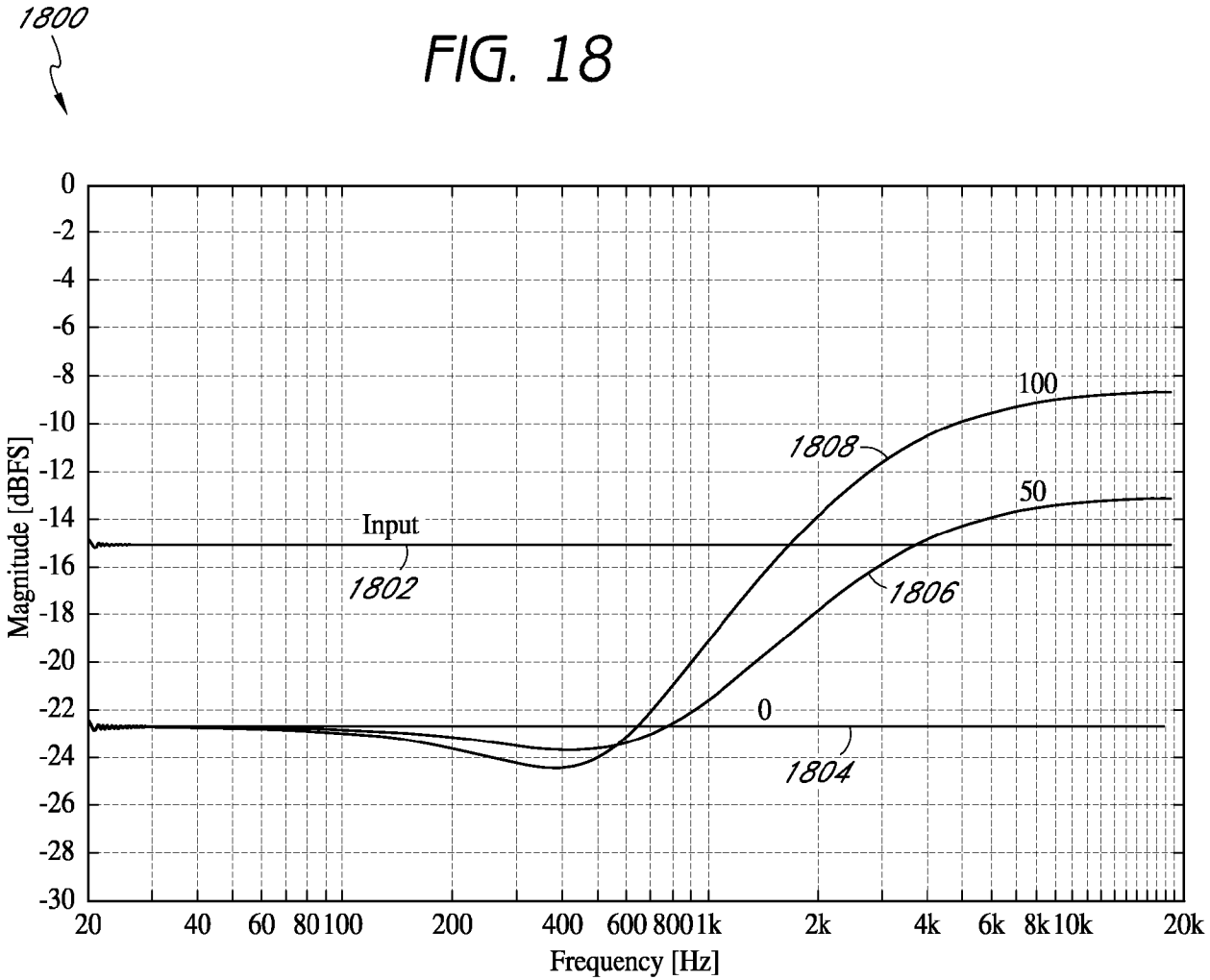

FIG. 18 illustrates an example graph 1800 that shows an embodiment of the definition filter frequency responses. Three frequency responses are shown represented by traces 1804, 1806, and 1808. The trace 1804 illustrates a definition amount of about 0%. The trace 1806 illustrates a definition amount of about 50%. The trace 1808 illustrates a definition amount of about 100%.

The trace 1804 is about −22.5 dBFS for the entire frequency range shown. The trace 1806 starts at about −22.5 dBFS, decreases to about −23.5 dBFS at about 400 kHz, and increases to about −13 dBFS at about 10 kHz. The trace 1808 starts similarly at about −22.5 dBFS and decreases to about −24.5 dBFS at about 400 Hz, and increases to about −8.7 dBFS at about 10 kHz.

In certain embodiments, the traces shown in the graph 1900 are applied to the front left and front right outputs, e.g. using the definition modules 393*a* and 393*b*.

Figure 19:
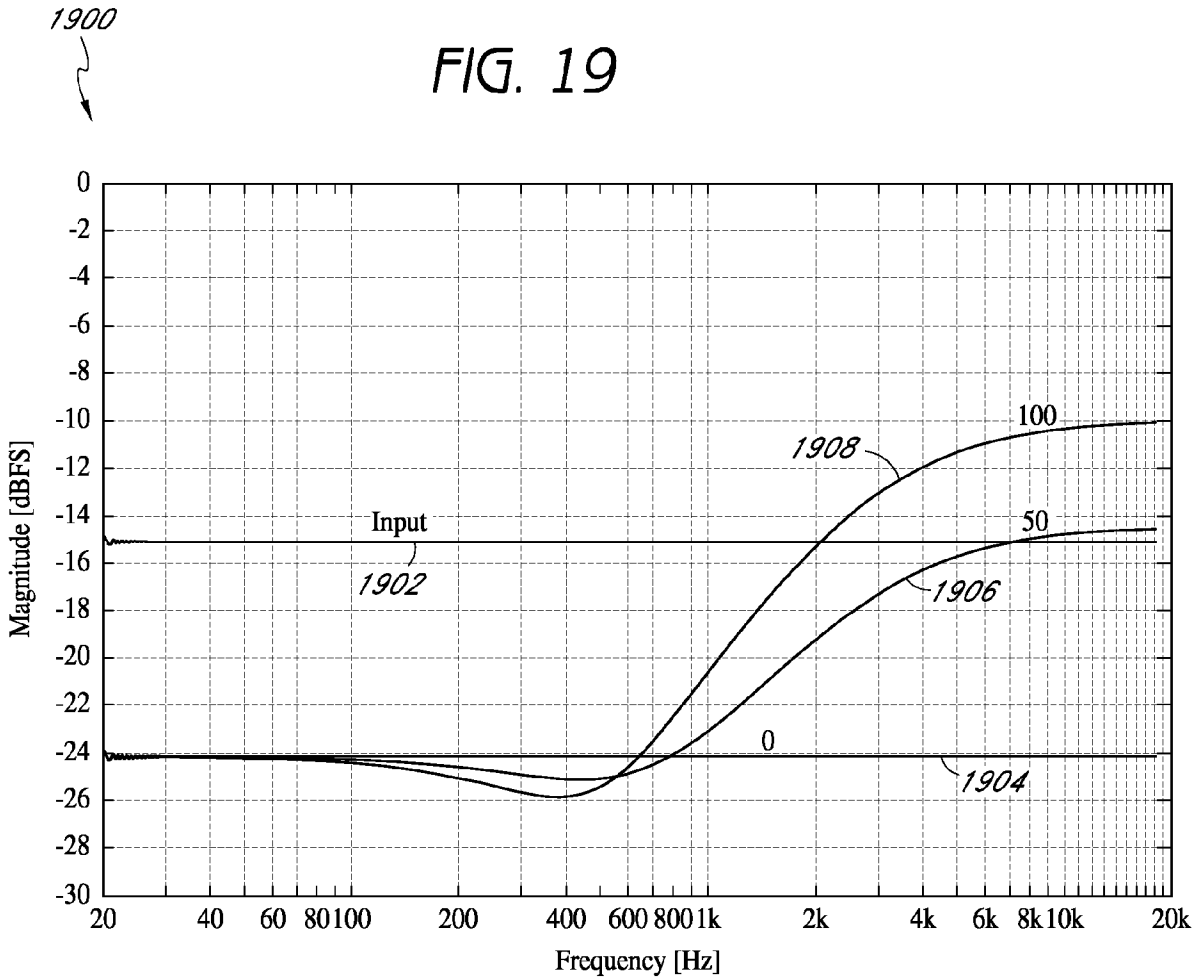

FIG. 19 illustrates a graph 1900 that depicts example embodiments of frequency responses of a definition filter, such as the definition filter 393*c* applied to the front center output in the audio system 300. The definition filter frequency responses shown include 3 frequency responses represented by traces 1904, 1906 and 1908 which correspond to values of definition control of 0%, 50%, and 100% respectively.

The trace 1904 is about −24 dBFS throughout the entire frequency spectrum. The trace 1906 starts at about −24 dBFS at about 20 Hz, decreases to about −23 dBFS at about 400 Hz, and increases to about −14.5 dBFS at about 10 kHz, and the trace 1908 starts at about −24 dBFS at about 20 Hz and decreases to about −26 dBFS at about 400 Hz, and increases to about −10 dBFS at about 10 kHz.

Depending on the embodiment, certain acts, events, or functions of any of the methods described herein can be performed in a different sequence, may be added, merged, or left out all together (e.g., not all described acts or events are necessary for the practice of the method). Moreover, in certain embodiments, acts or events may be performed concurrently, e.g., through multi-threaded processing, interrupt processing, or multiple processors, rather than sequentially.

The various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. The described functionality may be implemented in varying ways for each particular application, but such implementation decisions should not be interpreted as causing a departure from the scope of the disclosure.

The various illustrative logical blocks, modules, and circuits described in connection with the embodiments disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the embodiments disclosed herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

While the above detailed description has shown, described, and pointed out novel features as applied to various embodiments, it will be understood that various omissions, substitutions, and changes in the form and details of the device or process illustrated may be made without departing from the spirit of the disclosure. As will be recognized, certain embodiments of the inventions described herein may be embodied within a form that does not provide all of the features and benefits set forth herein, as some features may be used or practiced separately from others. The scope of the inventions is indicated by the appended claims rather than by the foregoing description. All changes which come within the meaning and range of equivalency of the claims are to be embraced within their scope.

What is claimed is:

1. A method for processing audio signals, the method comprising:

receiving left and right front audio signals, the left and right front audio signals each comprising information about a front spatial position of a sound source relative to a listener;

receiving left and right rear audio signals, the left and right rear audio signals each comprising information about a rear spatial position of a sound source relative to a listener;

applying one or more definition filters to the filtered left and right front output signals to enhance the left and right front input signals, the one or more definition filters comprising a high-pass shelving filter configured to produce left and right front output signals;

providing the left and right front output signals to first front speakers;

applying at least one rear perspective filter to each of the left and right rear audio signals to yield left and right rear output signals; and applying the left and right rear output signals to second front speakers, wherein the left and right rear output signals are each configured to drive one of the second front speakers to simulate a rear surround sound effect.

2. The method of claim 1, further comprising enhancing dialog of at least one of (a) the left and right front audio signals and (b) a center front audio signal.

3. The method of claim 1, further comprising enhancing a bass response associated with at least the filtered left and right front output signals.

4. The method of claim 1, wherein the at least one rear perspective filter comprises a combination of a high pass filter, a first low pass filter, and a second low pass filter.

5. The method of claim 4, wherein the high pass filter has a corner frequency of about 13 kHz.

6. The method of claim 4, wherein the first low pass filter has a corner frequency of about 950 Hz.

7. The method of claim 4, wherein the second low pass filter has a corner frequency of about 8 kHz.

8. The method of claim 1, further comprising processing at least a portion of the filtered left and right front output signals and the filtered left and right rear output signals with a crossover network.

9. The method of claim 1, wherein the method is implemented by one or more processors.

10. A system for processing audio signals, the system comprising:

a definition module configured to:

receive left and right front audio signals each comprising information about a front spatial position of a sound source relative to a listener, apply one or more definition filters comprising a high-pass shelving filter to the left and right front input signals to enhance the left and right front input signals and thereby produce left and right front output signals, and output the left and right front output signals for playback by first front speakers; and at least one rear perspective filter configured to:

receive left and right rear audio signals each comprising information about a rear spatial position of a sound source relative to a listener, filter each of the left and right rear audio signals to yield left and right rear output signals, and output the left and right rear output signals for playback by second front speakers, wherein the left and right rear output signals are each configured to drive one of the second front speakers to simulate a rear surround sound effect.

11. The system of claim 10, further comprising a dialog clarity module configured to enhance dialog in at least one of (a) the left and right front audio signals and (b) a center front audio signal.

12. The system of claim 10, further comprising a bass management module configured to enhance a bass response associated with one or more of the filtered left and right front output signals and a subwoofer audio signal.

13. The system of claim 10, further comprising a dialog clarity module is configured to enhance dialog in at least one of (a) the left and right front audio signals and (b) a center front audio signal by emphasizing formants in a high frequency range of speech.

14. The system of claim 10, wherein the at least one rear perspective filter comprises a combination of a high pass filter, a first low pass filter, and a second low pass filter.

15. The system of claim 14, wherein the high pass filter has a corner frequency of about 13 kHz.

16. The system of claim 14, wherein the first low pass filter has a corner frequency of about 950 Hz.

17. The system of claim 14, wherein the second low pass filter has a corner frequency of about 8 kHz.

18. The system of claim 10, wherein one or both of the definition module and the at least one rear perspective filter are implemented by one or more processors.

* * * * *

UNITED STATES PATENT AND TRADEMARK OFFICE

CERTIFICATE OF CORRECTION

PATENT NO. : 8,509,464 B1
APPLICATION NO. : 13/286082
DATED : August 13, 2013
INVENTOR(S) : Kato et al.

It is certified that error appears in the above-identified patent and that said Letters Patent is hereby corrected as shown below:

In the Claims

In column 23 line 13, In Claim 13, after "module" delete "is".

Signed and Sealed this
Sixth Day of January, 2015

Michelle K. Lee

Michelle K. Lee
*Deputy Director of the United States Patent and Trademark Office*